US009466234B1

(12) United States Patent
Demarco et al.

(10) Patent No.: US 9,466,234 B1
(45) Date of Patent: Oct. 11, 2016

(54) SPORTS EVENT ADVERTISING DISPLAY SYSTEM

(71) Applicant: Allstate Insurance Company, Northbrook, IL (US)

(72) Inventors: Joseph M. Demarco, Vernon Hills, IL (US); Joseph J. Berghammer, Evanston, IL (US); J. Pieter van Es, Irvine, CA (US)

(73) Assignee: Allstate Insurance Company, Northbrook, IL (US)

( * ) Notice: Subject to any disclaimer, the term of this patent is extended or adjusted under 35 U.S.C. 154(b) by 0 days.

(21) Appl. No.: 14/617,552

(22) Filed: Feb. 9, 2015

Related U.S. Application Data

(63) Continuation of application No. 13/728,704, filed on Dec. 27, 2012, now Pat. No. 8,968,122, which is a continuation of application No. 13/469,518, filed on May 11, 2012, now Pat. No. 8,366,570, which is a (Continued)

(51) Int. Cl.
*A63B 63/00* (2006.01)
*G09F 17/00* (2006.01)

(Continued)

(52) U.S. Cl.
CPC ..... *G09F 23/0066* (2013.01); *A63B 71/022* (2013.01); *A63B 63/008* (2013.01)

(58) Field of Classification Search
CPC A63B 63/004; A63B 71/022; A63B 61/003; A63B 63/008; G09F 23/0066; G09F 17/00; G09F 19/22
USPC ..... 473/434, 435, 476–478, 454; 273/395, 273/396, 398–402; 40/602, 604, 606.18, 40/598, 606.03, 606.19, 615, 617
See application file for complete search history.

(56) References Cited

U.S. PATENT DOCUMENTS 3,672,672 A 6/1972 Rubin
3,964,197 A 6/1976 Tucker et al.
4,165,576 A 8/1979 Joselevich (Continued)

FOREIGN PATENT DOCUMENTS

DE 3822422 A1 1/1990
DE 4113481 A1 11/1991

(Continued)

OTHER PUBLICATIONS

Aug. 4, 2014—(US) Non-Final Office Action—U.S. Appl. No. 13/853,296.

(Continued)

*Primary Examiner* — Mark Graham
(74) *Attorney, Agent, or Firm* — Banner & Witcoff, Ltd.

(57) ABSTRACT

A netting apparatus adapted to display advertising content at a sporting event is disclosed. The netting apparatus comprises a net and a plurality of mesh netting pieces. The net may comprise an open mesh netting, wherein the open mesh netting is adapted to safely stop a ball without significant obstruction of view through the open mesh netting. The mesh netting may also include a plurality of cut-out portions. Each piece of the plurality of mesh netting pieces may be colored and each piece may be in the shape of a logo such that each piece corresponds to a one of the plurality of cut-out portions on the net. Each piece may be attached to the net such that the net and the plurality of mesh netting pieces do not overlap each other with each mesh netting piece located within the corresponding cut-out portion of the net.

20 Claims, 20 Drawing Sheets

Related U.S. Application Data continuation of application No. 12/618,392, filed on Nov. 13, 2009, now abandoned, which is a continuation-in-part of application No. 12/550,275, filed on Aug. 28, 2009, now abandoned.

(51) Int. Cl.
*G09F 23/00* (2006.01)
*A63B 71/02* (2006.01)

(56) References Cited

U.S. PATENT DOCUMENTS

| | | | | |
|---|---|---|---|---|
| 4,344,628 | A * | 8/1982 | Warehime | A63B 63/06 273/127 R |
| 4,906,503 | A * | 3/1990 | De La Cruz | G09F 7/18 116/173 |
| 4,921,257 | A | 5/1990 | Heller | |
| 5,177,890 | A | 1/1993 | Hisatomi et al. | |
| 5,280,904 | A | 1/1994 | Rodriguez | |
| 5,307,578 | A | 5/1994 | Fichtenau | |
| 5,342,021 | A | 8/1994 | Watson | |
| 5,393,437 | A | 2/1995 | Bower | |
| 5,441,239 | A | 8/1995 | Watson | |
| 5,964,070 | A | 10/1999 | Redl et al. | |
| 6,299,554 | B1 | 10/2001 | Sinclair et al. | |
| 6,688,026 | B1 | 2/2004 | Clark | |
| 6,811,501 | B2 * | 11/2004 | Kuzia | A63B 63/00 473/172 |
| 6,986,915 | B2 | 1/2006 | Bourdages | |
| 7,117,619 | B1 | 10/2006 | Huber | |
| 8,430,771 | B1 * | 4/2013 | Berghammer | G09F 23/0066 40/604 |
| 2002/0092218 | A1 | 7/2002 | Black | |
| 2002/0115508 | A1 | 8/2002 | Bourdages | |
| 2004/0157687 | A1 | 8/2004 | Bourdages | |
| 2006/0105865 | A1 | 5/2006 | Bourdages | |
| 2006/0128238 | A1 * | 6/2006 | Arnold | A63B 61/003 442/43 |
| 2007/0082763 | A1 * | 4/2007 | Esser | A63B 61/003 473/459 |
| 2007/0090601 | A1 | 4/2007 | Liao | |
| 2008/0067751 | A1 | 3/2008 | Hunt | |

FOREIGN PATENT DOCUMENTS

| | | | |
|---|---|---|---|
| EP | 0231719 | A2 | 8/1987 |
| EP | 1241654 | A1 | 9/2002 |
| GB | 2323390 | A | 9/1998 |
| JP | 05106372 | | 4/1993 |
| JP | 06149158 | | 5/1994 |
| JP | 08129339 | | 5/1996 |
| JP | 08190355 | | 7/1996 |
| JP | 10031442 | | 2/1998 |
| JP | 10049089 | | 2/1998 |

OTHER PUBLICATIONS

Nov. 6, 2014—(US) Final Office Action—U.S. Appl. No. 13/853,296.

Spagnoli, L., "Sign of the Times", Philadelphia Citypaper, Naked City, Aug. 1-24, 2000;1-2 Downloaded http://citypaper.net/articles/081700/nc.signs.shtml?print=1.

"IHL Test Goal Ads with Free Powerade Display in Finals", Street & Smith's Sports Business Daily, Jun. 5, 1998;1 Downloaded http://www.sportsbusinessdaily.com/index.cfm?fuseaction=archive.printArticles&articleId-32403.

Beane, M., et al., "Clear Directions", Panstadia International Quarterly Report, Article code: 61-046, 1999, 6:1, p. 1-5 Downloaded http://panstadia.com/textfiles/61 texthtml/61-046.htm.

Zegnal, J., "Ad Firm, City Quarrel Over Use of Scaffoling Net for Advertising", Budapest Business Journal, Factiva, Inc., Jan. 28, 2002:1-2.

"Billboards Going Atop Fenway's Green Monster", The Associated Press State & Local Wire, Jul. 11, 2002:1.

"Nonwovens . . . Engineered Fabric Solutions", Inda Nonwovens Glossary, Inda Association of the Nonwoven Fabrics Industry, 2002:1-5.

"About Nonwovens", Inda Association of the Nonwoven Fabrics Industry, 1997/2009:1 Downloaded http://inda/org/about/nonwovens.html.

Hunt, W., "Theme Parks & Entertainment Environments", Urban Graphics Entertainment, Madison Square Press, 1997:1-3.

Bass, J., "Major League Soccer Stadium Graphics", Treehouse Design Partnership, 164-167.

Oct. 20, 2011—(US) Non-Final Office Action—U.S. Appl. No. 13/215,827.

* cited by examiner

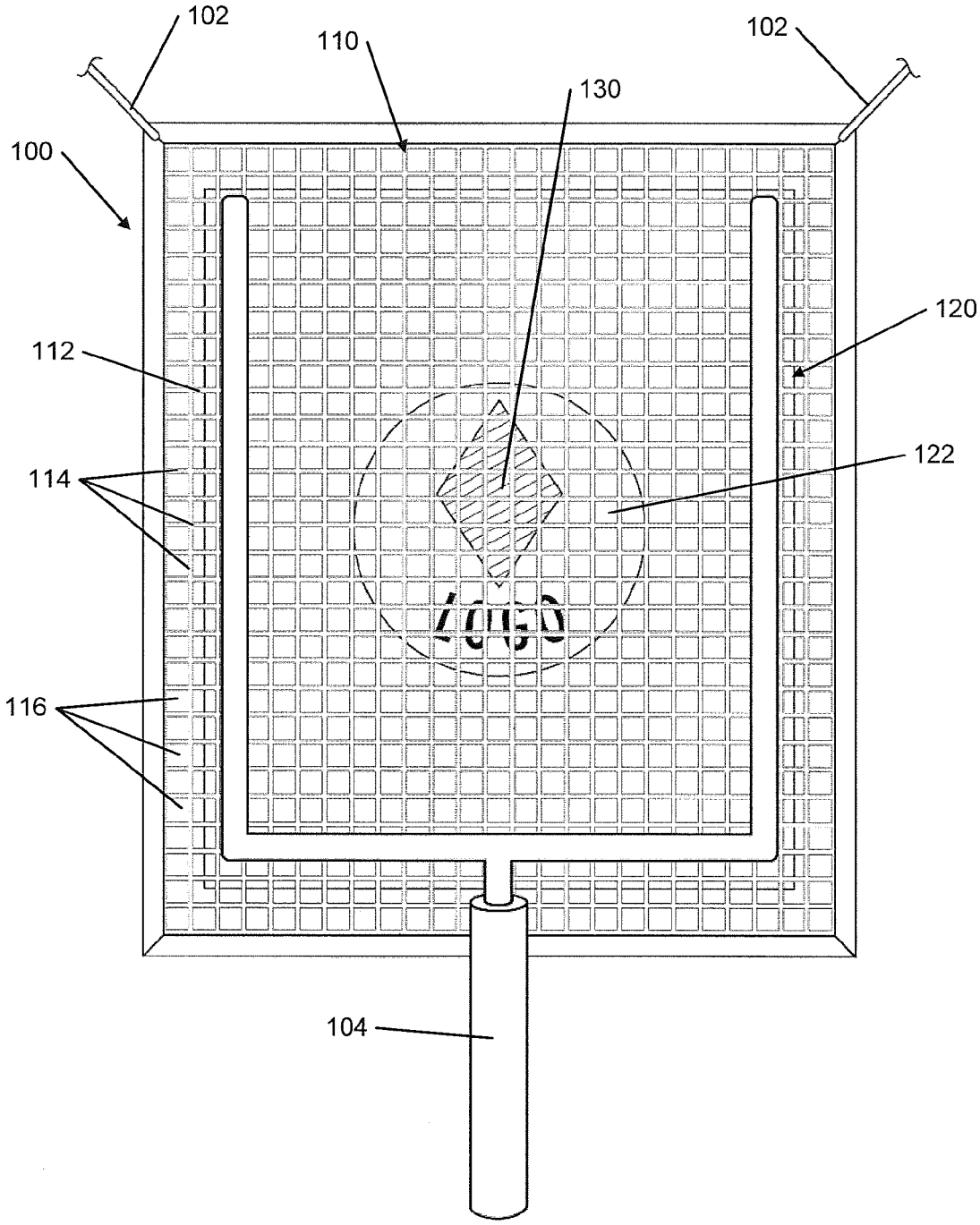
FIG. 1B1

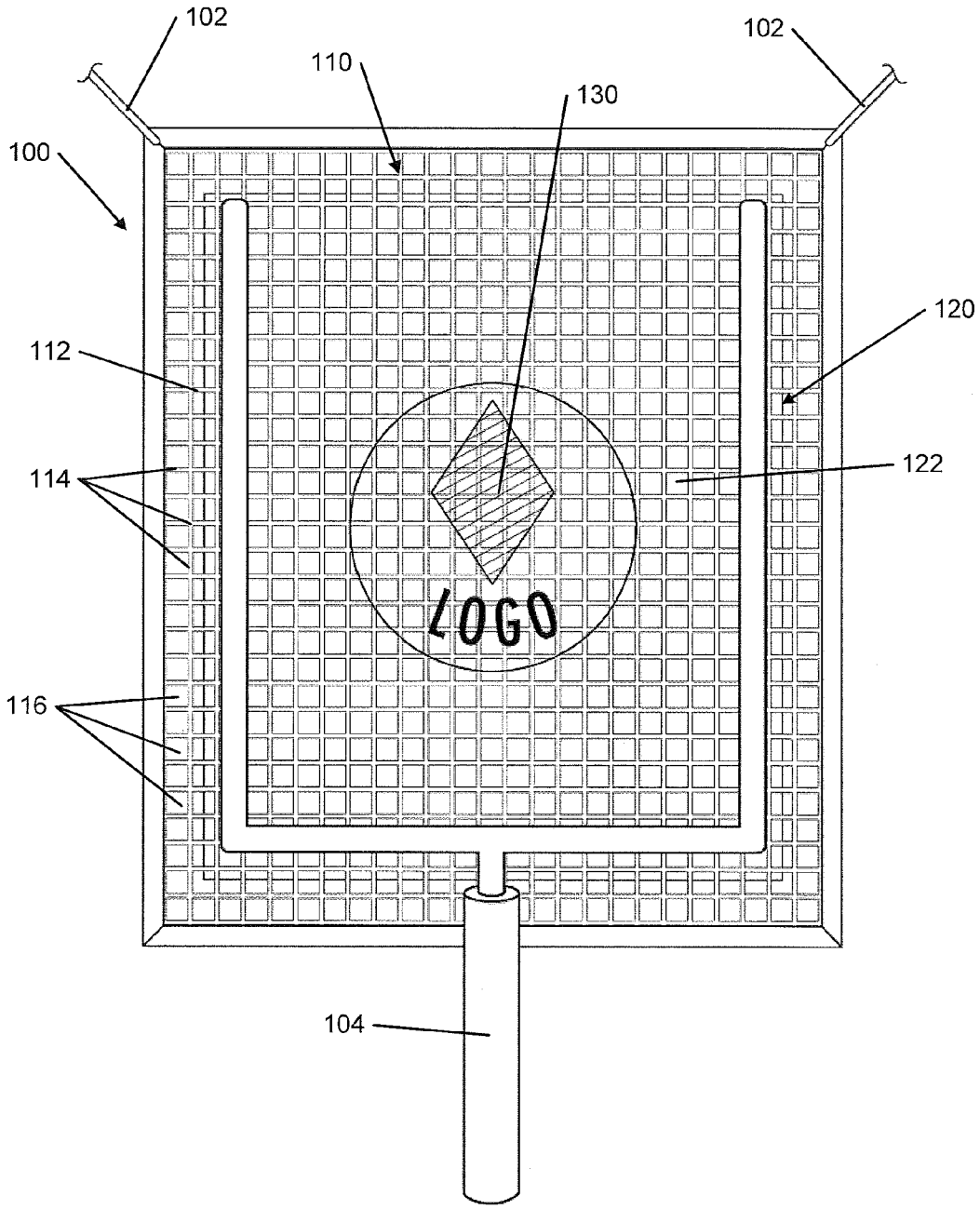
FIG. 1B2

SPORTS EVENT ADVERTISING DISPLAY SYSTEM

This patent application is a continuation of U.S. application Ser. No. 13/728,704 filed Dec. 27, 2012, which is a continuation of U.S. application Ser. No. 13/469,518 filed May 11, 2012, which is a continuation of U.S. application Ser. No. 12/618,392 filed Nov. 13, 2009, which is a continuation in part of U.S. application Ser. No. 12/550,275 filed Aug. 28, 2009, which are incorporated herein by reference in their entirety.

FIELD OF THE INVENTION

The present invention is directed towards an apparatus for netting at sporting events, more specifically towards an apparatus for netting that will stop balls at a sporting event and further adapted to display advertising content.

BACKGROUND

Protective netting is commonly used at sporting events to protect spectators from sporting objects, such as balls or other equipment, being thrown or kicked from an athletic field. The protective netting is typically suspended by a plurality of cables from the ceiling within an enclosed stadium, or in the alternative, stretched and attached between a plurality of frame structures within a stadium. The protective net generally comprises a wide mesh such that the spectators in the stadium retain a substantially unobstructed view of the goal or field of play upon which the sporting actions may occur.

Additionally, the dimensions of the openings of the mesh will vary according to whether the protective net is designed to block or prevent the passage of small objects, such as hockey pucks or baseballs, or larger objects, such as footballs. Objects such as hockey pucks, baseballs, or footballs may be herein described as sporting equipment.

While much attention has been given to the protection of spectators at a sporting event through the provision of safety nets, there has been minimal attention given to the displaying of advertising content on these same safety nets.

BRIEF SUMMARY OF THE INVENTION

The following presents a general summary of aspects of the invention. This summary is not intended as an extensive overview of the invention. It is not intended to identify key or critical elements of the invention or to delineate the scope of the invention. The following summary merely presents some concepts of the invention in a general form as a prelude to the more detailed description provided below. In an aspect of the present invention, a netting apparatus is adapted to display advertising content at a sporting event comprises a net and a set of mesh netting pieces. The net may comprise an open mesh netting with strands which define a plurality of first-sized mesh openings. The net may further comprise a plurality of cut-out portions. The open mesh netting may be adapted to safely stop a ball without significant obstruction of view through the open mesh netting. The set of mesh netting pieces may have a second mesh netting with strands which define a plurality of second-sized mesh openings. The set of mesh netting pieces may be colored and in the shape of a logo such that each mesh netting piece corresponds to one of the plurality of cut-out portions on the net. Each mesh netting piece may be attached to the net such that the net and the mesh netting pieces do not overlap each other with each mesh netting piece located within the corresponding cut-out portion of the net. The first-sized mesh openings may be larger than the second-sized mesh openings. Each mesh netting piece may be attached to the net by sewing each mesh netting piece into a corresponding one of the plurality of cut-out portions of the net. Each mesh netting piece may have black outlining on the edges of the piece. The set of mesh netting pieces may be painted on a first side and at least partially painted on a second side opposite the first side. The netting apparatus may further comprise a solid material attached to the net and located behind the first net and the set of netting pieces.

In another aspect of this invention, a netting apparatus adapted to display advertising content at a sporting event, the netting apparatus comprises a net and a plurality of panel pieces. The net may comprise an open mesh netting, wherein the open mesh netting is adapted to safely stop a ball without significant obstruction of view through the open mesh netting. The plurality of panel pieces may comprise a solid material with the plurality of panel pieces attached to the net. The net may be colored or painted with a first logo. The plurality of panel pieces may be colored and each piece of the plurality of panel pieces is in the shape of a second logo. The plurality of panel pieces may be attached to the net such that the second logo substantially matches the first logo. Additionally, each piece of the plurality of panel pieces may be attached to the net by individual stitching of each piece to the net. The net may be painted on a first side and at least partially painted on a second side opposite the first side. The solid material may be nonwoven fabric. The solid material may be not significantly see-through. Additionally, the solid material may be a solid color.

In another aspect of this invention, a sports blocking and display apparatus comprises a first panel and a set of mesh netting pieces. The first panel may comprise an open mesh netting adapted to block sports equipment. The open mesh netting may include openings that are dimensioned to safely block the sports equipment from passing completely through the first panel without significant obstruction of view through the open mesh netting. The open mesh netting may further comprise multiple cut-out portions. The plurality of mesh netting pieces may have a second mesh netting with strands which define a plurality of second-sized mesh openings. The pieces in the plurality of mesh netting pieces may be colored and each of the pieces may be cut into the shape of a logo or letters of the logo such that each mesh netting piece corresponds to a cut-out portion on the net. Additionally, each mesh netting piece may be attached to the net such that the net and the mesh netting pieces do not substantially overlap each other with each mesh netting piece located within the corresponding cut-out portion of the net. The sports blocking and display apparatus may further comprise a solid material attached to the net and located behind the first panel and the plurality of mesh netting pieces. The solid material may be nonwoven fabric. The solid material may be not significantly see-through. The solid material may be a solid color. The solid material may be painted or colored with a logo. The logo painted or colored on the solid material may match the logo created by the plurality of mesh netting pieces. The solid material may have sufficient strength, both wet and dry, to not tear when contacted by the sports equipment as such sports equipment is typically used in a sporting event.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein:

FIG. 1B1 illustrates a front plan view of another example netting apparatus in accordance with this invention;

FIG. 1B2 illustrates a front plan view of another example netting apparatus in accordance with this invention;

FIG. 2 illustrates a front plan view of another example netting apparatus in accordance with this invention;

Figure 1A:
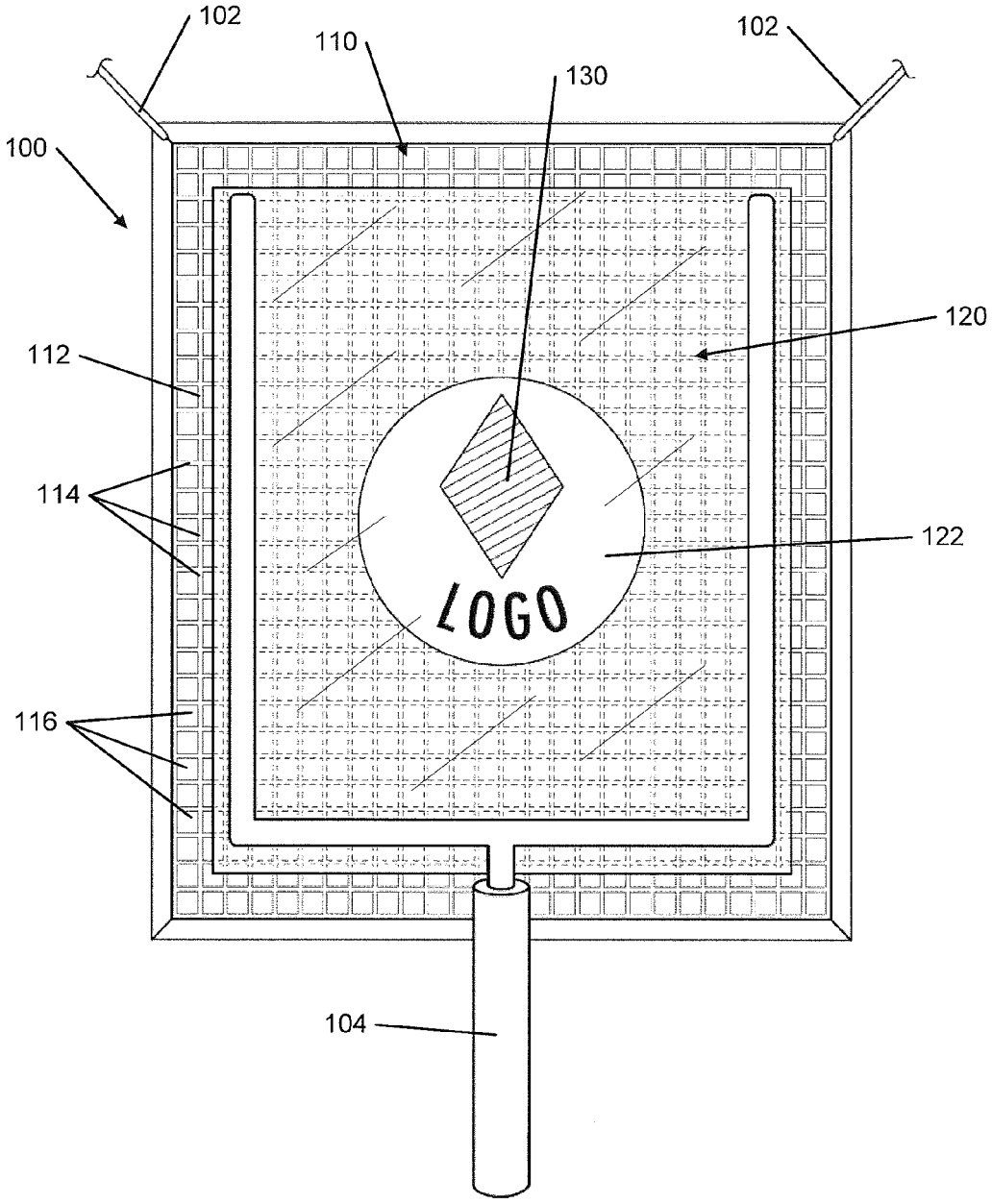
FIG. 1A illustrates a front plan view of an example netting apparatus in accordance with the present invention.

The reader is advised that the attached drawings are not necessarily drawn to scale.

DETAILED DESCRIPTION OF THE INVENTION

In the following description of various examples of the invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

FIGS. 1A, 1B1, and 1B2 illustrate a netting apparatus 100 for use at a sporting event that may display advertising content. The netting apparatus 100 may be used for the protection of spectators from sporting objects, such as balls or other equipment, from being thrown or kicked from an athletic field. The netting apparatus 100 may be suspended by a plurality of cables 102 from the ceiling within an enclosed stadium, or in the alternative, stretched and attached between a plurality of frame structures within a stadium. The netting apparatus 100 may be a permanent netting structure within the stadium or sporting event, such as the netting behind home plate at a baseball game. Additionally, the netting apparatus 100 may be a temporary structure used at specific times during a sporting event, such as the netting that is raised behind the field goal posts 104 when a field goal or extra point is kicked in a football game. In one example in accordance with this invention, the netting apparatus 100 is generally comprised of a first panel 110 and a second panel 120. The first panel 110 may comprise an open mesh netting 112. The second panel 120 may comprise a solid material 122.

The first panel 110 includes an open mesh netting 112 that may include strands 114 or threads. The strands 114 may consist of textile fibers, metal, plastics, or other materials. The strands 114 define a plurality of mesh openings 116. The mesh openings 116 may be sized such that the open mesh netting 112 is adapted to safely stop a ball or other object without significant obstructions of view through the open mesh netting 112.

Figure 1C:
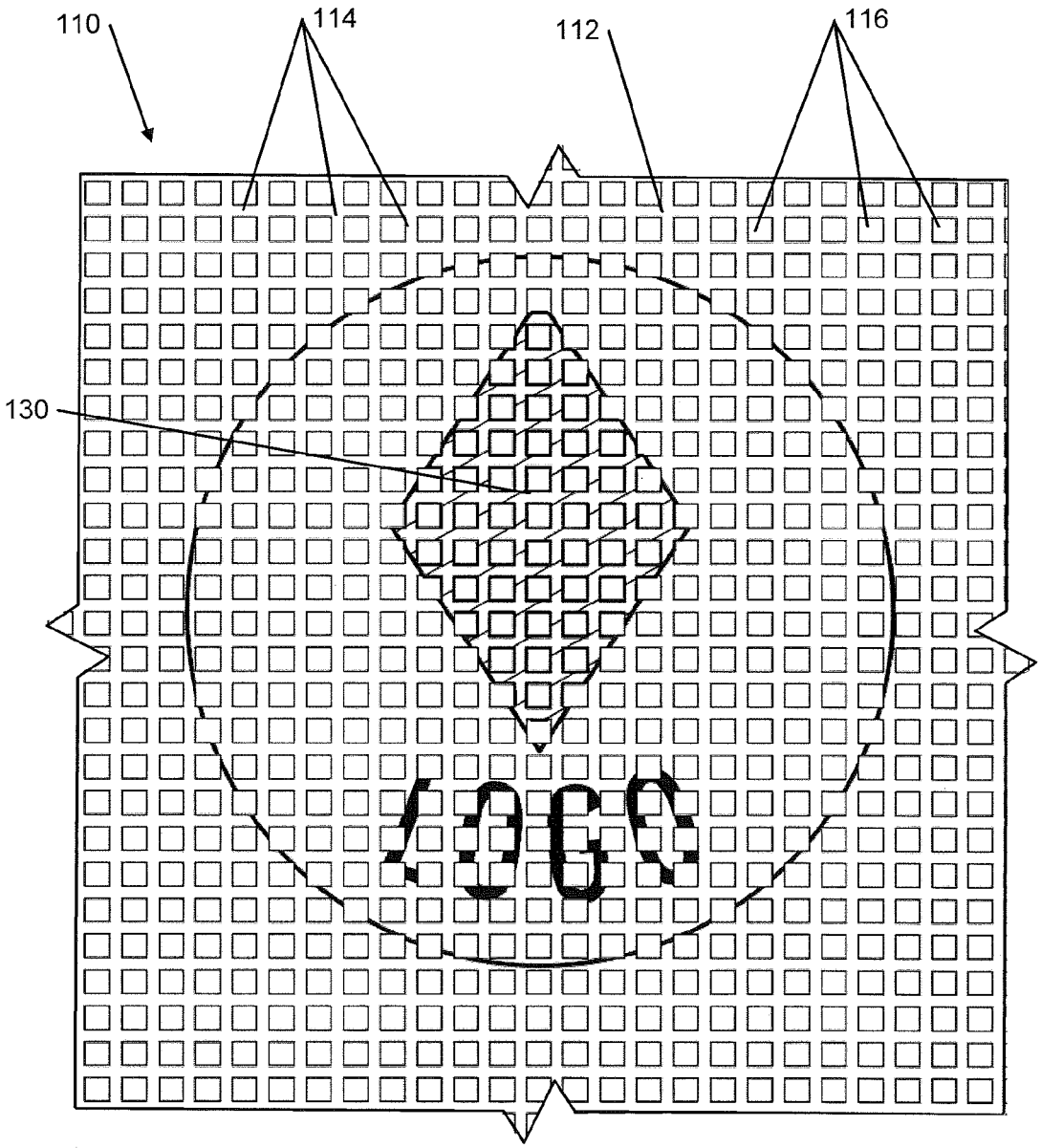
FIG. 1C illustrates a close-up front view of the first panel as shown in FIGS. 1A and 1B2, in accordance with this invention.
Figure 1D:
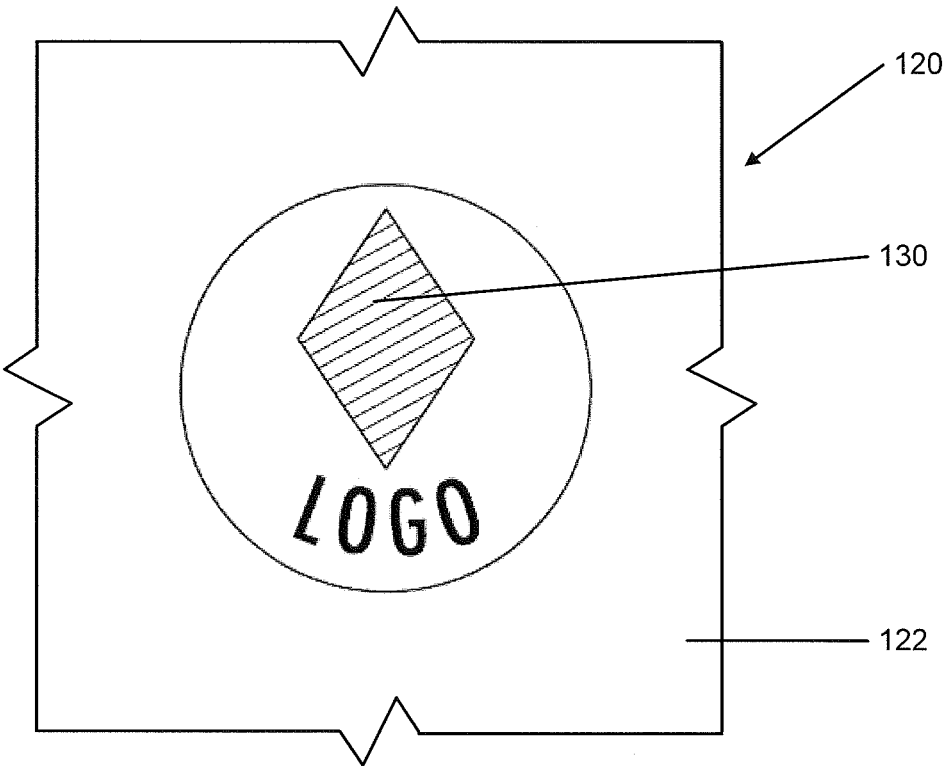
FIG. 1D illustrates a close-up front view of the second panel as shown in FIGS. 1A, 1B1, and 1B2, in accordance with this invention.

The second panel 120 includes a solid material 122. The second panel 120 may be located either directly in front of the first panel 110 (as illustrated in FIG. 1A) or directly behind the first panel 110 (as illustrated in FIGS. 1B1 and 1B2). Additionally, the second panel 120 may be attached to the first panel 110 by a variety of methods such as sewn together, clipped with fasteners, or any other similar method used to attach the first panel 110 to the second panel 120. The second panel 120 may be see-through, such that the spectators are able to significantly view the sporting event or sports activities through the second panel 120 when the second panel 120 is in position. The second panel 120 may also be not significantly see-through, such that the spectators are not able to significantly view the sporting event or sports activities through the second panel 120 when the second panel 120 is in position.

Figure 1E:
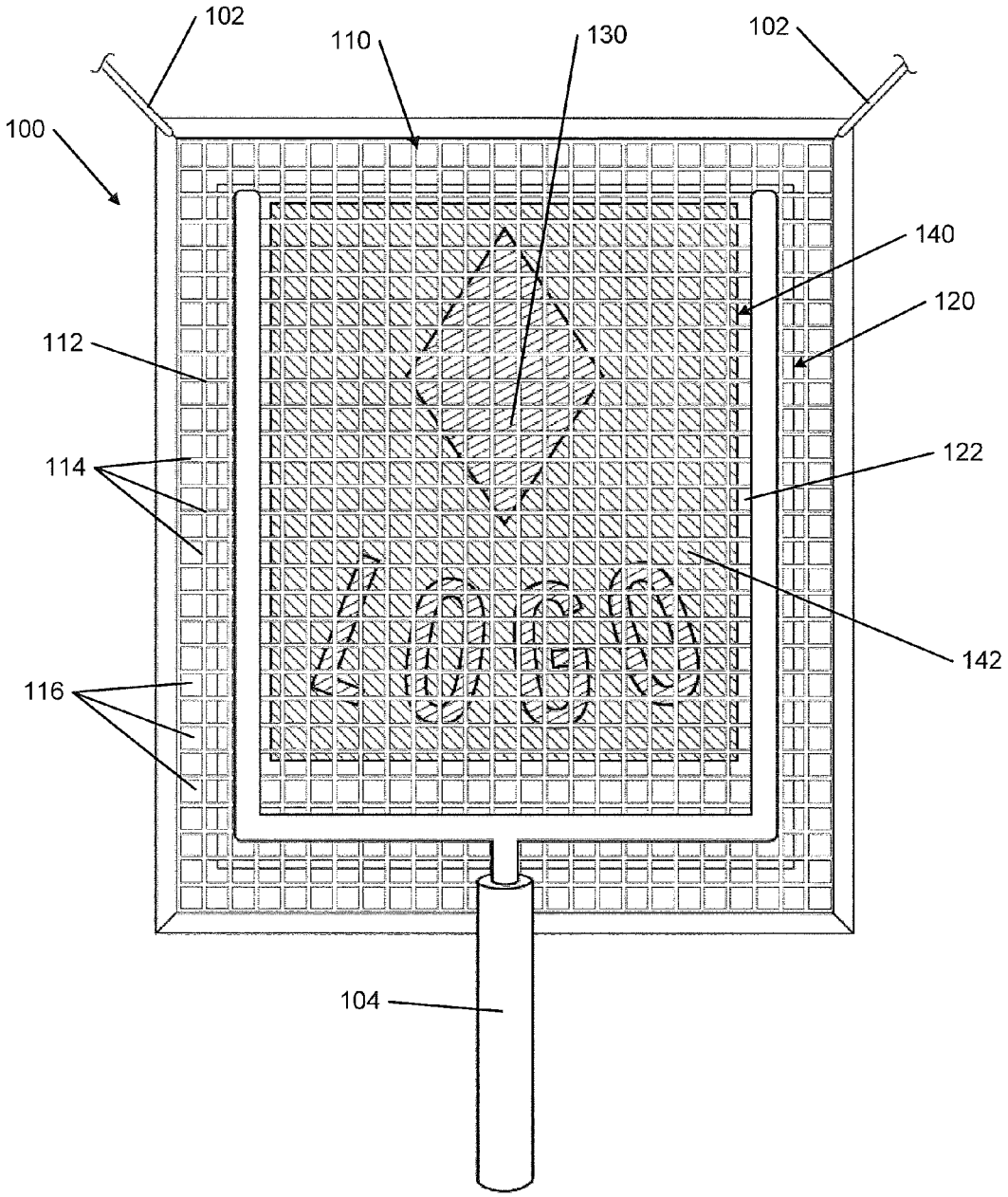
FIG. 1E illustrates a front plan view of another example netting apparatus in accordance with this invention.
Figure 2:
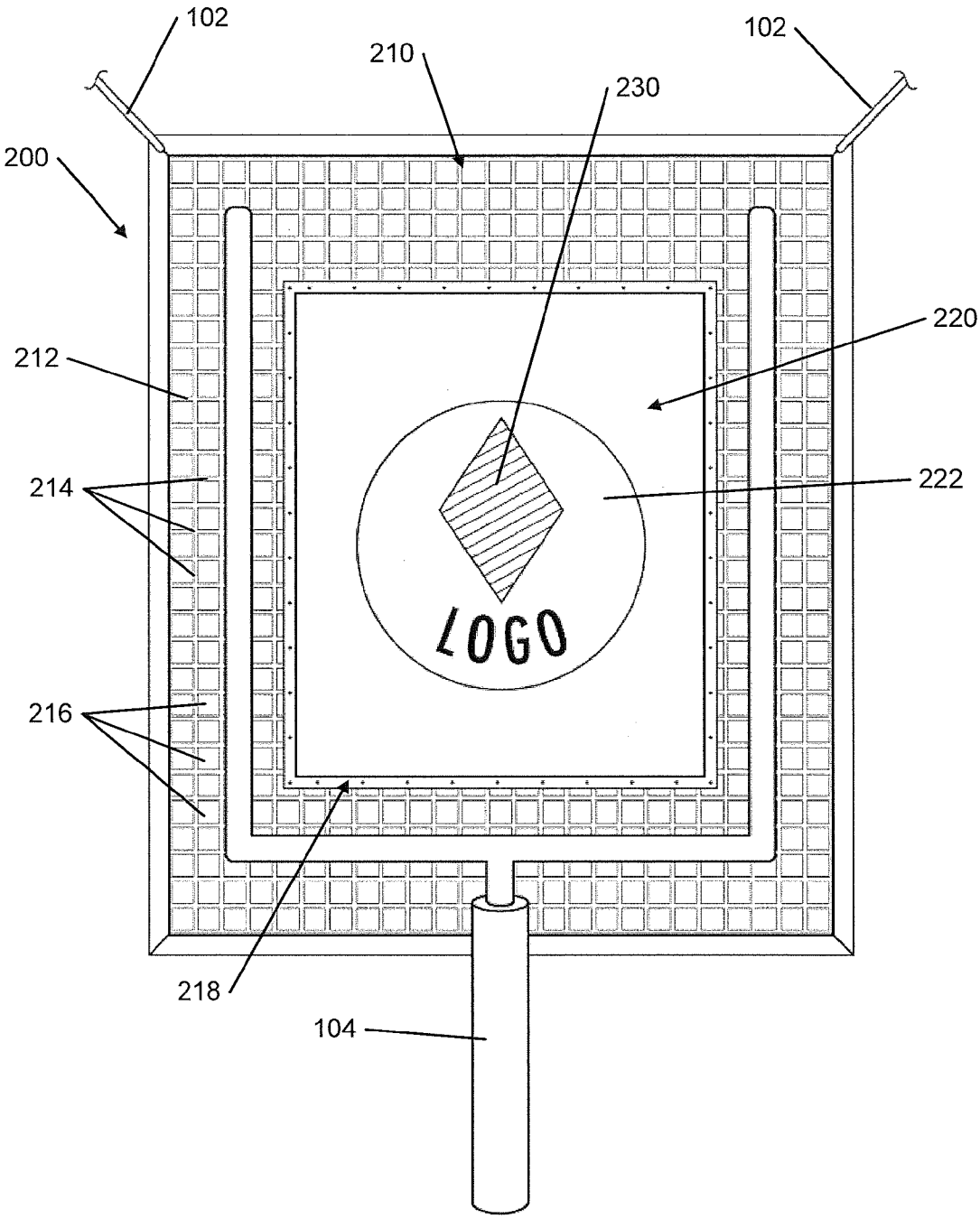

In another example according to this invention, FIG. 1E illustrates a netting apparatus 100 for use at a sporting event similar to the nets illustrated in FIGS. 1A, 1B1, and 1B2 and described above. The netting apparatus 100 illustrated in FIG. 1E includes the first panel 110 and the second panel 120 as described above. In addition, the netting apparatus 100 may include a third panel 140. The third panel 140 includes a solid material 142 and may be of a color that contrasts with the color of the second panel 120. The third panel 140 may be located directly behind the second panel 120. The third panel 140 may be attached to the second panel 120 or the first panel 110 by a variety of methods such as sewn together, clipped with fasteners, or any other similar method used to attach the third panel 140 to the second panel 120 or the first panel 110. The third panel 140 may be see-through, such that the spectators are able to significantly view the sporting event or sports activities through the third panel 140 with the third panel 140 is in position. The third panel 140 may also be not significantly see-through and thereby significantly obstructs the spectator's view, such that the spectators are not able to significantly view the sporting event or sports activities through the third panel 140 when the third panel 140 is in position.

The solid material 122 of the second panel 120 and/or the solid material 142 of the third panel 140 may consist of a nonwoven fabric. In an embodiment the nonwoven fabric may be formed from lyocell fibers, polyester fibers, polypropylene fibers, rayon fibers or a blend of one or more of these fibers. Lyocell fibers may be included in the nonwoven fabric due to the high strength, both wet and dry, as well as their resistance to wrinkles, superior draping properties and dyeability. The nonwoven fabric may be manufactured through chemical, mechanical or physical bonding, in certain embodiments.

Nonwoven fabrics generally provide specific advantages and functions such as absorbency, liquid repellency, resilience, stretch, softness, strength, washability, and filtering. The use of a nonwoven fabric as the solid material 122 of the second panel 120 and/or the solid material 142 of the third panel 140 provides many benefits for the intended use. The absorbency of the nonwoven fabric is beneficial for coloring or printing the logos 130 on the netting apparatus 100, such that the pigments may be absorbed and retained within the nonwoven fabric. The resilience, stretch, and strength characteristics of the nonwoven fabric may be beneficial for hanging the netting apparatus 100, as well as for providing a durable, long-lasting netting apparatus 100. Additionally, the strength and stretch of the nonwoven fabric may be beneficial for stopping, blocking, and/or deflecting footballs, baseballs, hockey pucks or the like. Additionally, the resilience of the nonwoven fabric may be beneficial because the netting apparatus 100 may be stored between plays and/or games and the ability of the netting apparatus to spring back after being crushed, wrinkled, or stored will help preserve the aesthetic look of the netting apparatus 100. In an embodiment, the nonwoven fabric does not exhibit visible wrinkles to spectators sitting in a football stadium when the nonwoven material is used in connection with a football net despite the nonwoven material having been stored for a day or more prior to being visible to the spectators. The liquid repellency of the nonwoven fabric is beneficial when the netting apparatus 100 is located outside where it may be raining or wet. The washability of the nonwoven fabric will help preserve the aesthetic look of the netting apparatus 100, while also prolonging the life of the netting apparatus 100.

In an embodiment, the nonwoven material has sufficient strength, both wet and dry, to not tear when contacted by a football, hockey puck or other sports equipment as such equipment is typically used in a sporting event. In various embodiments, the nonwoven material will have a texture that simulates suede, leather or silk. In a particular embodiment, the texture of the nonwoven material simulates leather.

In an alternative example of the solid material 122 of the second panel 120 and/or the solid material 142 of the third panel 140 in accordance with this invention, the solid material 122 142 may include small cut portions or holes. These cut portions or holes may provide a means for air and wind to flow through the solid material 122 142. The cut portions may be slits of various shapes in the net, or may be in the form of holes. Because the solid material 122 142 may provide poor wind and air flow properties, cut portions may be used in a part of the solid material or throughout the solid material 122 142. The cut portions or holes may be incorporated in such a way that they are sufficient to allow wind to pass through the portions and diminish the pressure or force caused by the wind on the nonwoven fabric.

In accordance with this invention, other materials may be used for the solid material 122 142, such as fabric, polyester, linen, or cotton, or any other material with the properties beneficial for the second panel 120 and the third panel 140. The second panel 120 and/or third panel 140 may consist of a woven fabric or other cloth or cloth-like material. The second panel 120 and/or the third panel 140 may not have mesh openings as may be found in the first panel 110 and open mesh netting 112.

As illustrated in FIGS. 1A through 1E, the first panel 110, the second panel 120, or the third panel 140 can be colored or painted with a logo 130 and or words. FIG. 1A illustrates the second panel 120 in front of the first panel 110, wherein the second panel 120 includes the logo 130 and the first panel 110 may or may not include the logo 130. FIGS. 1B1 and 1B2 illustrate the second panel 120 behind the first panel 110, wherein the second panel 120 includes the logo 130 and the first panel 110 may or may not include the logo 130. In the particular embodiment shown in FIG. 1B1, the first panel 110 does not include the logo 130 and the second panel 120 includes the logo 130. In the particular embodiment shown in FIG. 1B2, the first panel 110 includes the logo 130 and the second panel 120 includes the logo 130. FIG. 1C illustrates a close-up view of the first panel 110 with a logo 130 colored or painted onto the first panel 110, which is made up of the mesh netting 112. FIG. 1D illustrates a close-up view of the second panel 120 with a logo 130 colored or painted onto the second panel 120 and solid material 122. In accordance with this invention, a logo 130 may include advertising content, words, pictures, shapes, company logos, sports team logos, messages, or any item that represents another item to be displayed. The logo 130 in the present invention is identified by a diamond shape with the word "LOGO" in the figures. As illustrated in FIGS. 1A through 1E, the shape of the solid material 122 of the second panel 120 and the solid material 142 of the third panel 140 is not approximately the same as the shape of the logo 130. In another example in accordance with this invention, the shape of the solid material 122 142 and the panel 120 140 may be approximately the same as the shape of the logo 130, such that the shape of the solid material 122 142 matches the shape of the logo 130. In another embodiment, the shape of the solid material 122 142 may be slightly larger and in a different shape than the logo 130.

The mesh netting 112 can be colored or painted with the logo 130. Additionally, the mesh netting 112 may be painted on one side with some bleed through to the other side or painted on both sides. Also, the solid material 122 142 can be colored or painted with the logo 130 in a manner that matches the logo 130 painted on the mesh netting 112. Also, the solid material 122 142 may not be painted or colored with the logo 130. Moreover, only the solid material 122 142 may be painted or colored with the logo 130 with the mesh netting 112 not painted or colored with the logo 130. To better improve the contrast with the mesh netting 112, the solid material 122 142 may be a solid color, such as black or white and the solid material 122 may be a color that is different from the color of the mesh netting 112. In an embodiment, the color of the colored portion of the solid material 122 142 and color of the colored portion of the mesh netting 112 can be identical to strengthen the visual appearance.

In an embodiment according to this invention, the logo 130 may be colored onto the nonwoven fabric of the solid material 122 142 by screen printing or bonding. Screen printing generally refers to a method of resin bonding a web of fibers within the nonwoven fabric by using a cylindrical screen. The cylindrical screen, containing a latex resin binder, is rolled and pressed against a moving nonwoven fabric. As the cylinder rotates against the fabric, adhesive binder is squeezed onto the fabric. The binder may then be dried thereby bonding the fabric. An advantage of screen printing or bonding (also referred to as latex printing) is that the amount of binder squeezed onto the fabric can be controlled by the pattern and hole sizes in the screen. Color pigments can be added to the binder, thus coloring and printing the logo 130 on the solid material 122 142 of the panels 120 140 as required.

FIG. 2 illustrates an example according to this invention similar to that described above in conjunction with FIGS. 1A through 1D (the same or similar reference numbers are used in FIG. 2 as those used in FIGS. 1A through 1D to denote the same or similar parts). FIG. 2 illustrates a netting apparatus 200 for use at a sporting event. In another example in accordance with this invention, as shown in FIG. 2, the netting apparatus 200 is generally comprised of a first panel 210 and a second panel 220. The first panel 210 may comprise an open mesh netting 212. The second panel 220 may comprise a solid material 222.

The first panel 210 includes an open mesh netting 212 that may include strands 214 or threads. The strands 214 may consist of textile fibers, metal, plastics, or other materials. The strands 214 define a plurality of mesh openings 216. The mesh openings 216 may be sized such that the open mesh netting 212 is adapted to safely stop a ball or other object without significant obstructions of view through the open mesh netting 212. Additionally, the first panel 210 includes a cut-out portion 218. The cut-out portion 218 may be located in the middle of the first panel 210.

As further illustrated in FIG. 2, the second panel 220 includes a solid material 222. The second panel 220 may be placed into the area of the cut-out portion 218 of the first panel 210, thereby creating one combined panel that includes the mesh netting 212 and the solid material 222. If the cut-out portion 218 is located in the middle of the first panel 210, the combined panel includes the mesh netting 212 around the periphery of the combined panel with the solid material 222 located in the middle of the combined panel. The cut-out portion can be located at a place other than the middle of the first panel. Additionally, the second panel 220 may be attached to the first panel 210 by a variety of methods such as sewn together, clipped with fasteners, glued, or any other similar method used to attach the first panel 210 to the second panel 220. When attached to each other, the first panel 210 and the second panel 220 may not overlap with each other. The second panel 220 may be see-through, such that the spectators are able to view the sporting event or sports activities through the second panel 220 when the second panel 220 is in position. The second panel 220 may also be not see-through, such that the spectators are not able to view or are not able to significantly view the sporting event or sports activities through the second panel 220 when the second panel 220 is in position.

As illustrated in FIG. 2, the solid material 222 is colored or painted with a logo 230. The mesh netting 212 may or may not be colored or painted with the logo 230 in accordance with this invention. As described above, the solid material 222 of the second panel 220 may consist of a nonwoven fabric, polyester, linen, or cotton, woven fabric, cloth or any other material with the properties beneficial for the second panel 220.

Figure 3A:
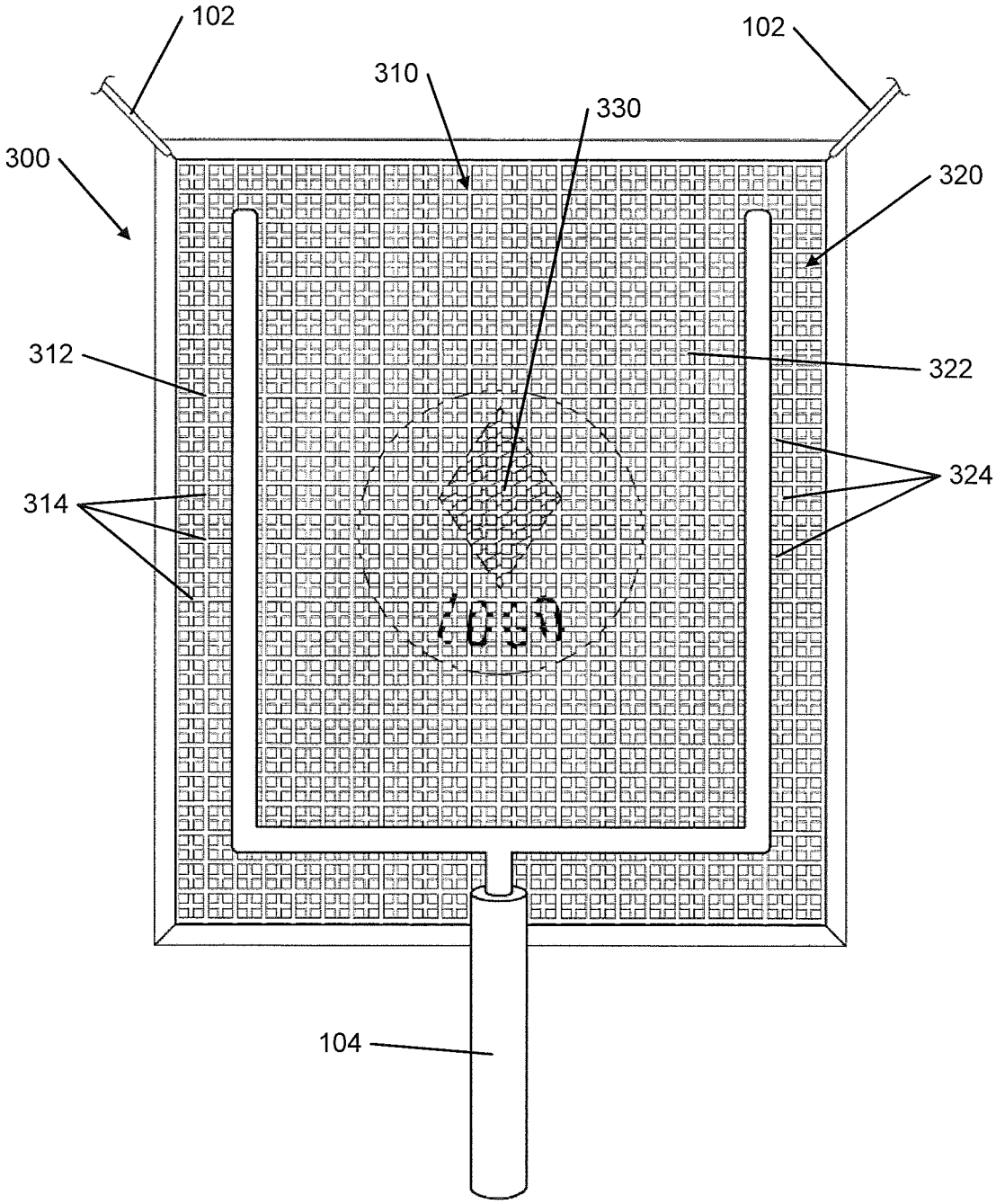
FIG. 3A illustrates a front plan view of another example netting apparatus in accordance with this invention.
Figure 3B:
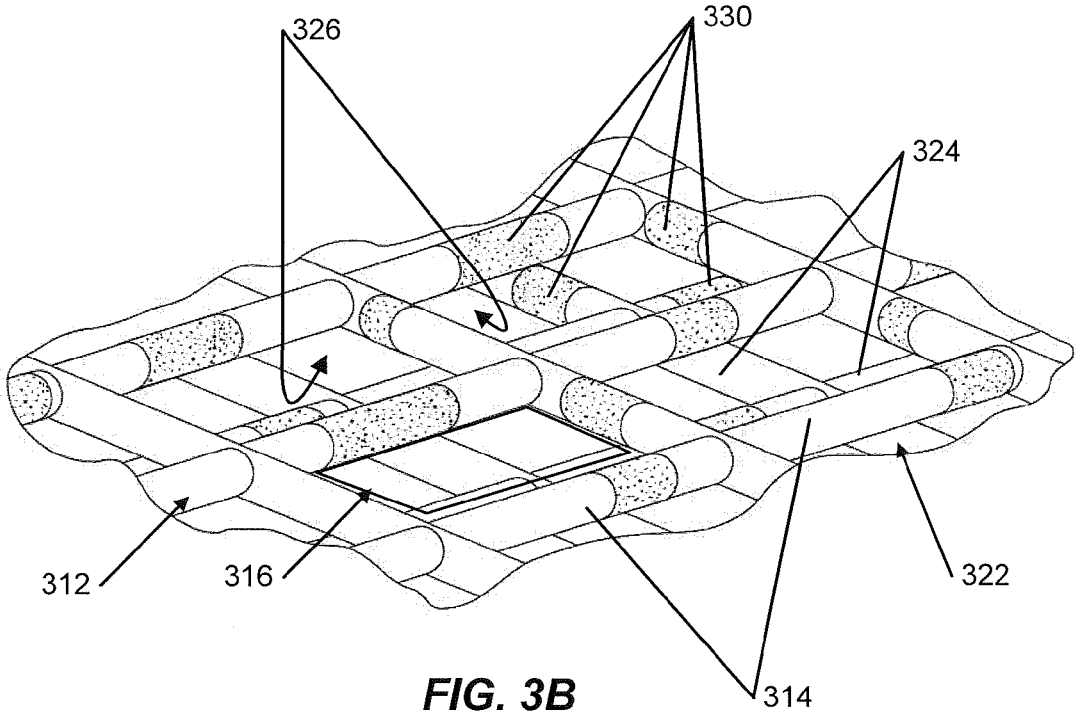
FIG. 3B illustrates a close-up perspective view of the netting apparatus as shown in FIG. 3A in accordance with this invention.

FIGS. 3A and 3B illustrate an example according to this invention similar to that described above in conjunction with FIGS. 1A through 1D (the same or similar reference numbers are used in FIGS. 3A and 3B as those used in FIGS. 1A through 1D to denote the same or similar parts). FIG. 3A illustrates a netting apparatus 300 for use at a sporting event. In another example in accordance with this invention, as shown in FIG. 3A, the netting apparatus 300 is generally comprised of a first net 310 and a second net 320. The first net 310 may comprise a first mesh netting 312. The second net 320 may also comprise a second mesh netting 322.

The first net 310 includes the first mesh netting 312 that may include strands 314 or threads. The strands 314 may consist of textile fibers, metal, plastics, or other materials. The strands 314 define a plurality of mesh openings 316. The mesh openings 314 may be sized such that the first mesh netting 312 is adapted to safely stop a ball or other object without significant obstructions of view through the first mesh netting 312.

The second net 320 includes the second mesh netting 322 that may include strands 324 or threads. The strands 324 may consist of textile fibers, metal, plastics, or other materials. The strands 324 define a plurality of mesh openings 326. The mesh openings 326 may be sized such that the second mesh netting 322 is adapted to safely stop a ball or other object without significant obstructions of view through the second mesh netting 322. Additionally, the mesh openings 316 of the first panel 310 may be exactly the same size as the mesh openings 326 of the second panel 320.

As shown in FIG. 3A, the second net is located either in front of or behind the first net in an offset manner. FIG. 3B illustrates a close-up perspective view showing the offset manner of the first net 310 and the second net 320. In the offset manner, the strands 314, 324 and the mesh openings 316, 326 of the first net 310 and the second net 320 do not match up perfectly. As shown in FIGS. 3A and 3B, the strands 314 from the first net 310 cover the mesh openings 326 from the second net 320, while the strands 324 from the second net 320 cover the mesh openings 316 from the first net 310. The second net 320 may be attached to the first net 310 by a variety of methods such as sewn together, clipped with fasteners, glued or any other similar method used to attach the first net 310 to the second net 320.

As illustrated in FIGS. 3A and 3B, the first net 310 and the second net 320 can be colored or painted with a logo 330. Additionally, the first net 310 and the second net 320 may be painted on one side with some bleed through to the other side or painted on both sides. By off-setting the first net 310 and the second net 320, more surface area is created for the paint and/or coloring so that the logo 330 can be better viewed by the spectators. A third net and or a fourth net that is/are painted or colored similar to the first net 310 and the second net 320 can be further added in an offset manner to an overall system of nets.

Figure 4:
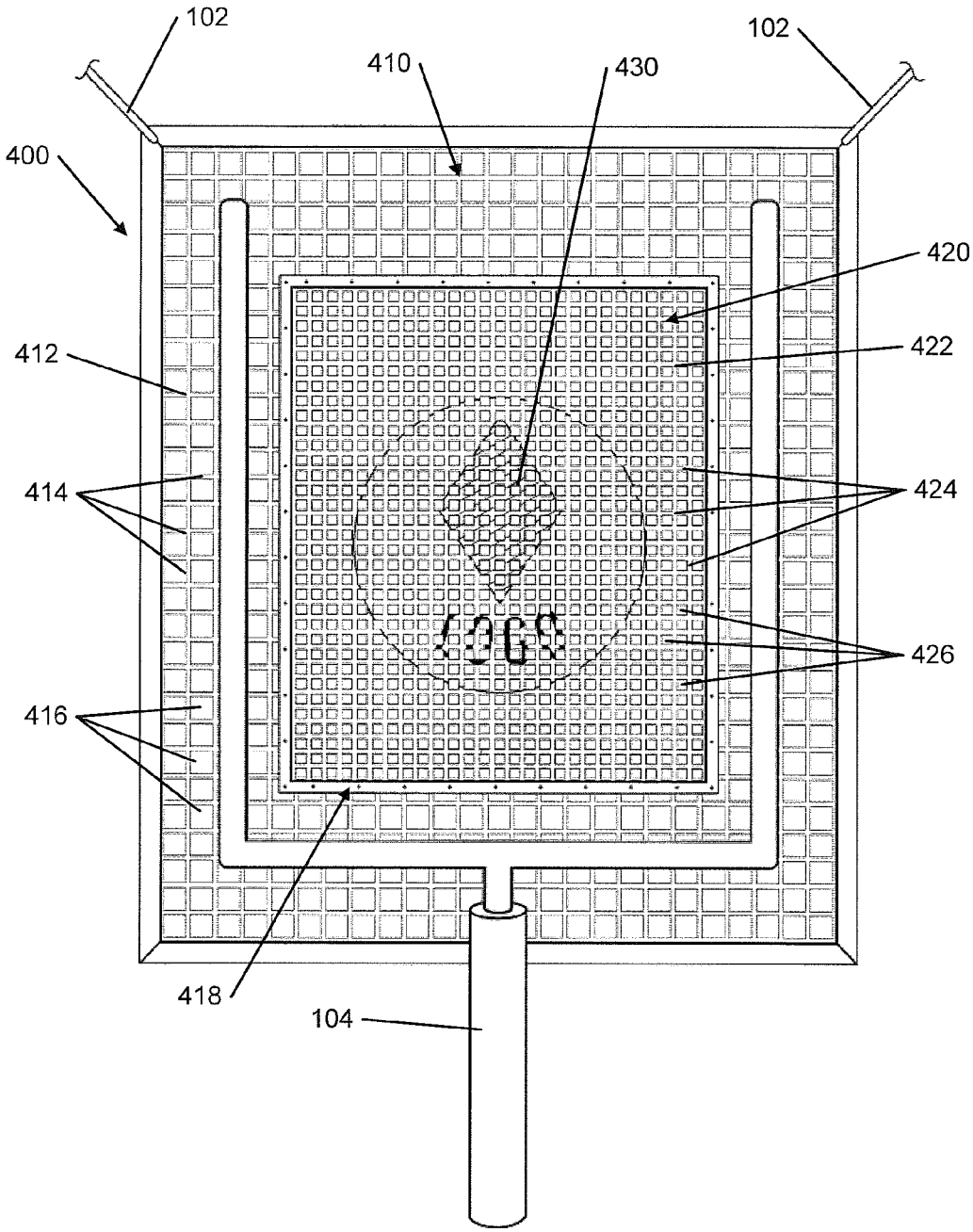
FIG. 4 illustrates a front plan view of another example netting apparatus in accordance with this invention.

FIG. 4 illustrates an example according to this invention similar to that described above in conjunction with FIGS. 1A through 1D (the same or similar reference numbers are used in FIG. 4 as those used in FIGS. 1A through 1D to denote the same or similar parts). FIG. 4 illustrates a netting apparatus 400 for use at a sporting event. In another example in accordance with this invention, as shown in FIG. 4, the netting apparatus 400 is generally comprised of a first net 410 and a second net 420. The first net 410 may comprise a first mesh netting 412. The second net 420 may also comprise a second mesh netting 422.

The first net 410 includes the first mesh netting 412 that may include strands 414 or threads. The strands 414 may consist of textile fibers, metal, plastics, or other materials. The strands 414 define a plurality of mesh openings 416. The mesh openings 416 may be sized such that the first mesh netting 412 is adapted to safely stop a ball or other object without significant obstructions of view through the first mesh netting 412. Additionally, the first net 410 includes a cut-out portion 418. The cut-out portion 418 may be located in the middle of the first net 410 or at another location of the first net.

The second net 420 includes the second mesh netting 422 that may include strands 424 or threads. The strands 424 may consist of textile fibers, metal, plastics, or other materials. The strands 424 define a plurality of mesh openings 426. The mesh openings 426 may be sized such that the second mesh netting 422 is adapted to safely stop a ball or other object without significant obstructions of view through the second mesh netting 422. The mesh openings 426 of the second net 420 are smaller than the mesh openings 416 of the first net 410.

The second net 420 may be placed into the area of the cut-out portion 418 of the first net 410, thereby creating one combined net that includes the first net 410 and the second net 420. If the cut-out portion 418 is located in the middle of the first net 410, the combined net includes the first net 410 with the first-sized mesh openings 416 around the periphery of the combined net with the second net 420 with the second-sized mesh openings 426 located in the middle of the combined net. Additionally, the second net 420 may be attached to the first net 410 by a variety of methods such as sewn together, clipped with fasteners, glued, or any other similar method used to attach the first net to the second net. When attached to each other, the first net 410 and the second net 420 may not overlap with each other.

As shown in FIG. 4, the second net 420 is colored or painted with a logo 430. Additionally, the second net 420 may be painted on one side with some bleed through to the other side or painted on both sides. The smaller-sized mesh openings 426 of the second net 420 thereby provide more surface area for the paint and/or coloring so that the logo 430 can be better viewed by the spectators. The first net 410 may or may not be colored or painted with the logo 430 in accordance with this invention.

Figure 5A:
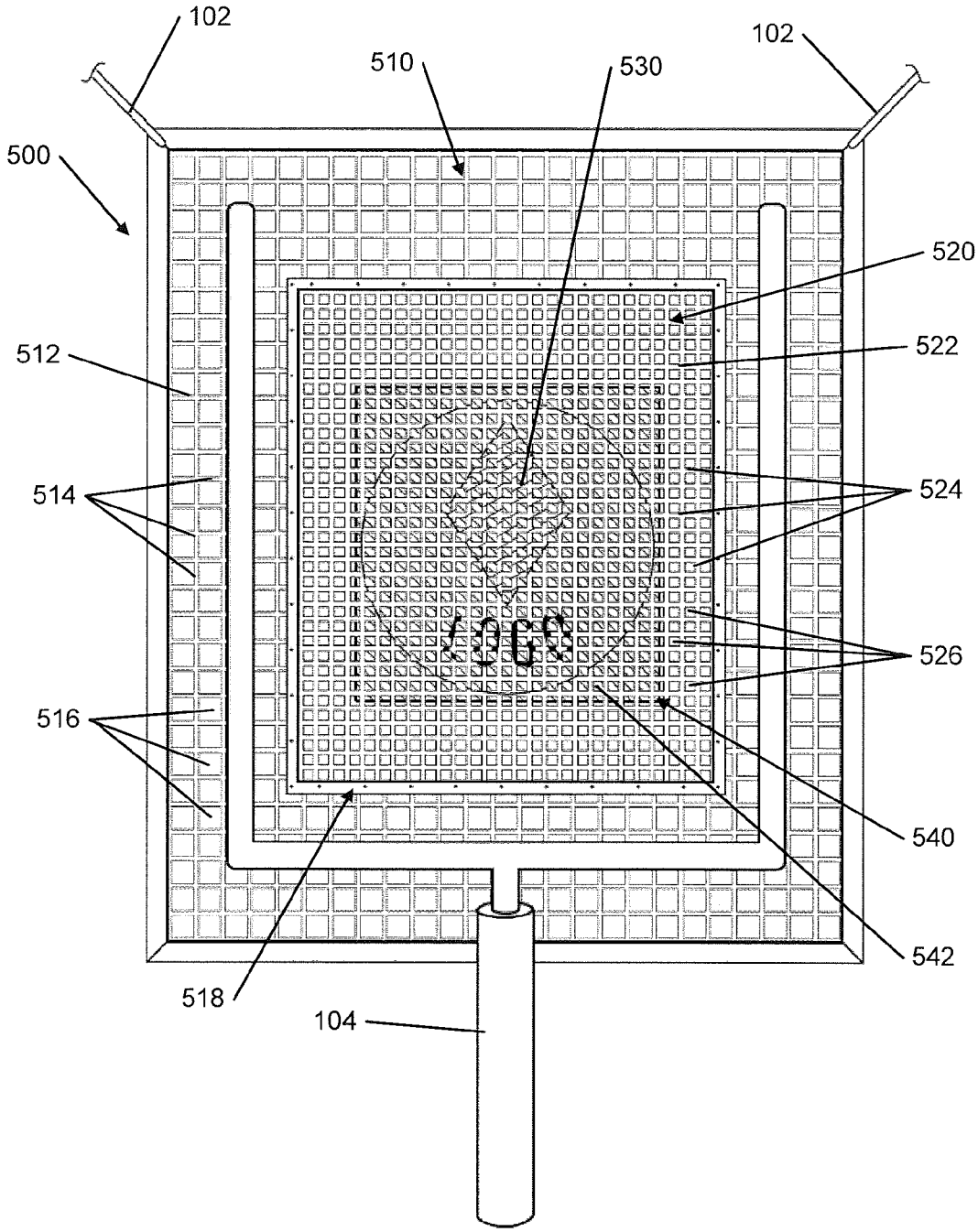
FIG. 5A illustrates a front plan view of another example netting apparatus in accordance with this invention.
Figure 5B:
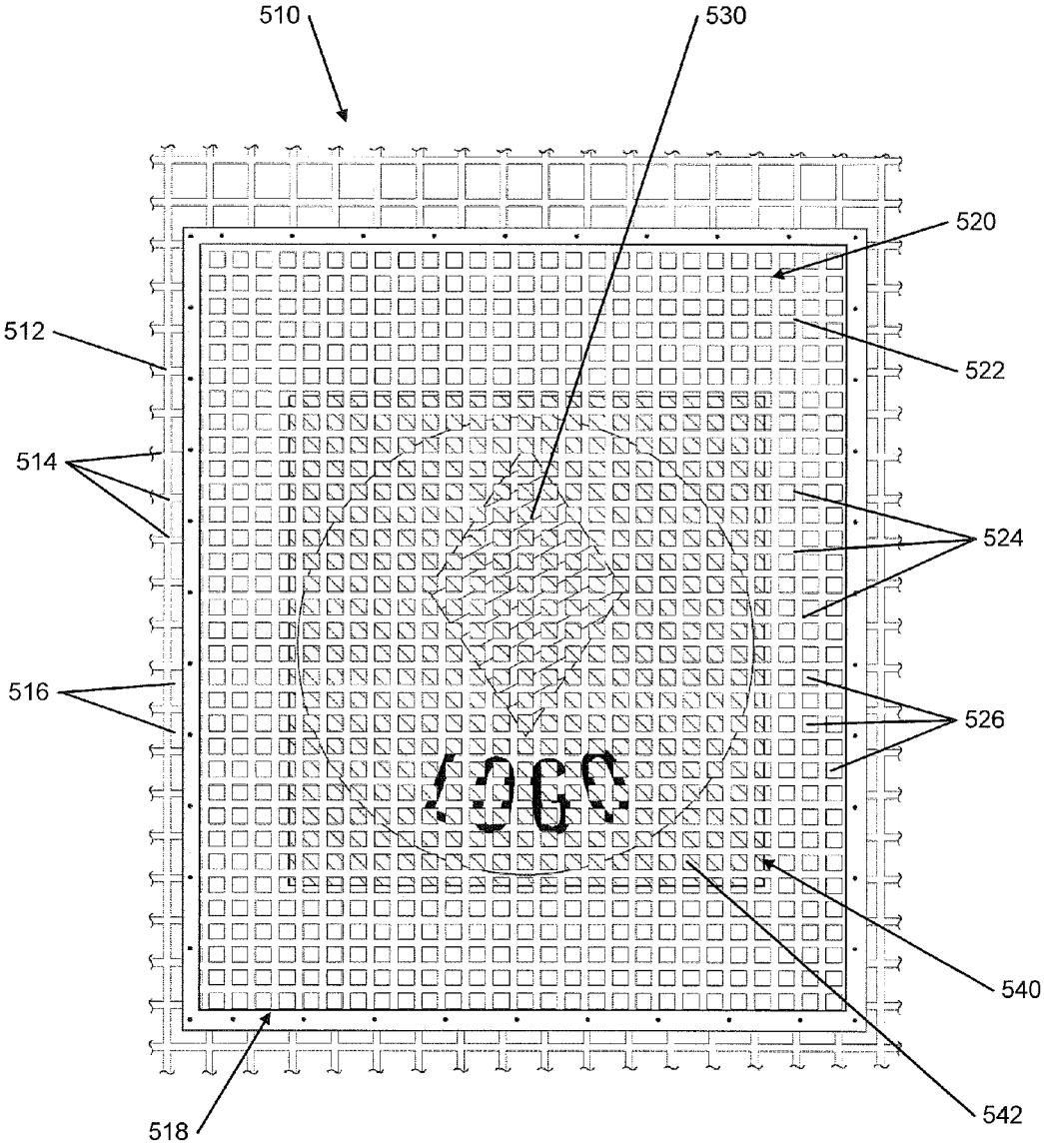
FIG. 5B illustrates a close-up view of the netting apparatus as shown in FIG. 5A in accordance with this invention.

FIGS. 5A through 5D illustrate examples according to this invention similar to that described above in conjunction with FIG. 4 (the same or similar reference numbers are used in FIGS. 5A through 5D as those used in FIG. 4 to denote the same or similar parts). FIGS. 5A through 5D illustrate a netting apparatus 500 for use at a sporting event. In another example in accordance with this invention, as shown in FIGS. 5A and 5B, the netting apparatus 500 is generally comprised of a first net 510, a second net 520, and a first panel 540. The first net 510 may comprise a first mesh netting 512. The second net 520 may comprise a second mesh netting 522 or a solid material. The first panel 540 may comprise a solid material 542.

The first net 510 includes the first mesh netting 512 that may include strands 514 or threads. The strands 514 may consist of textile fibers, metal, plastics, or other materials. The strands 514 define a plurality of mesh openings 516. The mesh openings 516 may be sized such that the first mesh netting 512 is adapted to safely stop a ball or other object without significant obstructions of view through the first mesh netting 512. Additionally, the first net 510 may include a cut-out portion 518. The cut-out portion 518 may be located in the middle of the first net 510 or at another location of the first net 510.

The second net 520 includes the second mesh netting 522 that may include strands 524 or threads. The strands 524 may consist of textile fibers, metal, plastics, or other materials. The strands 524 define a plurality of mesh openings 526. The mesh openings 526 may be sized such that the second mesh netting 522 is adapted to safely stop a ball or other object without significant obstructions of view through the second mesh netting 522. The mesh openings 526 of the second net 520 may be smaller than the mesh openings 516 of the first net 510. The second net 520 may comprise a solid material instead of the second mesh netting without departing from the invention.

The second net 520 may be placed into the area of the cut-out portion 518 of the first net 510, thereby creating one combined net that includes the first net 510 and the second net 520. Additionally, the first panel 540 may be attached to the second net 520 and located behind the second net 520. If the cut-out portion 518 is located in the middle of the first net 510, the combined net includes the first net 510 with the first-sized mesh openings 516 around the periphery of the combined net with the second net 520 with the second-sized mesh openings 526 located in the middle of the combined net. Additionally, the second net 520 may be attached to the first net 510 by a variety of methods such as sewn together, clipped with fasteners, glued, or any other similar method used to attach the first net 510 to the second net 520. When attached to each other, the first net 510 and the second net 520 may not overlap with each other in some examples. The first panel 540 may be attached to the second net 520 by a variety of methods such as sewn together, clipped with fasteners, glued, or any other similar method used to attach the first panel 540 to the second net 520.

As illustrated in FIGS. 5A and 5B, the second net 520 is colored or painted with a logo 530. Additionally, the second net 520 may be painted on one side with some bleed through to the other side or painted on both sides. The smaller-sized mesh openings 526 of the second net 520 thereby provide more surface area for the paint and/or coloring so that the logo 530 can be better viewed by the spectators. The first net 510 may or may not be colored or painted with the logo 530 without departing from this invention. The first panel 540 may create a contrast with the logo 530 and/or the letters of the logo 530, on the first net 510 and/or on the second net 520. The first panel 540 may or may not be colored or painted with the logo 530 without departing from this invention.

Figure 5C:
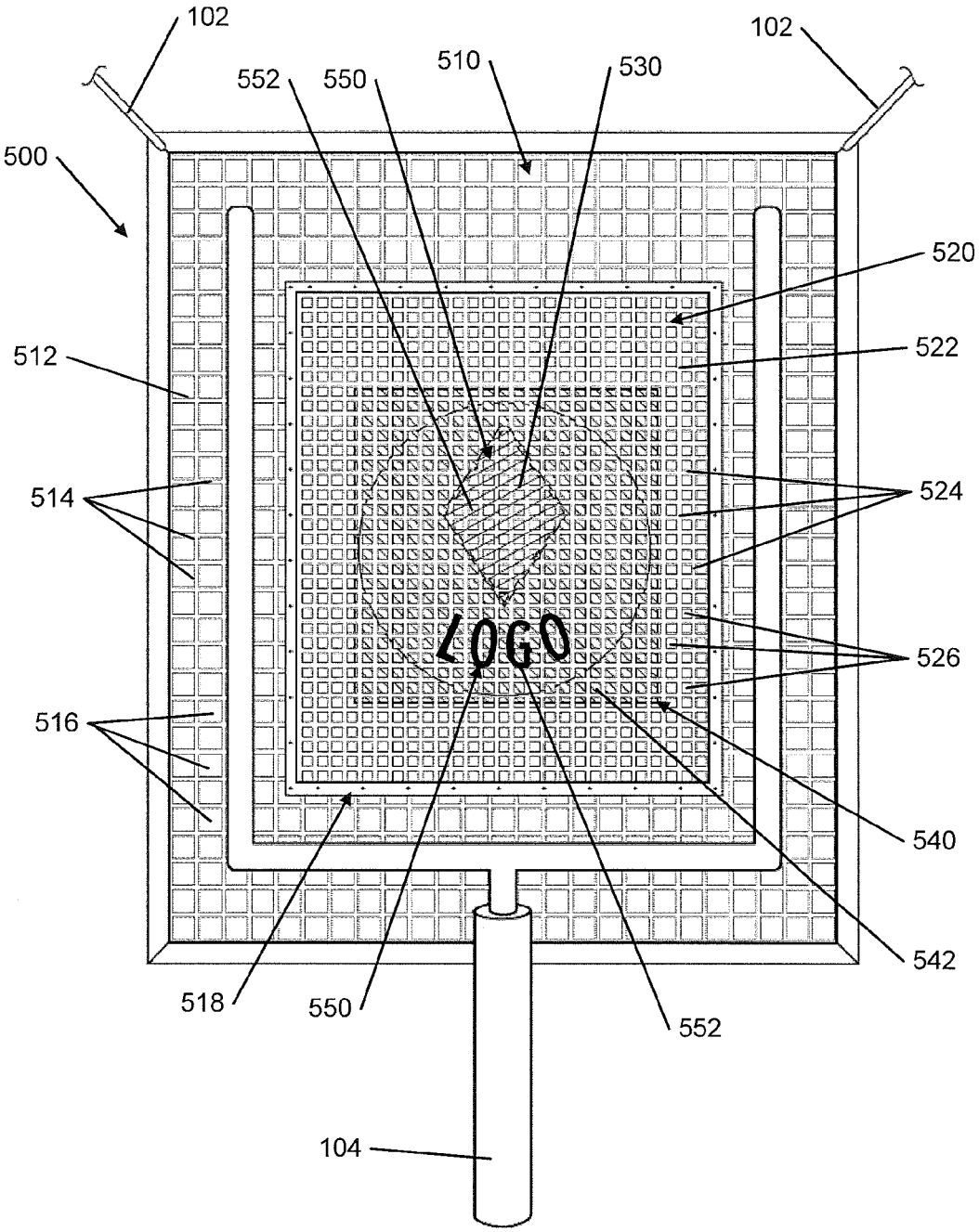
FIG. 5C illustrates a front plan view of another example netting apparatus in accordance with this invention.
Figure 5D:
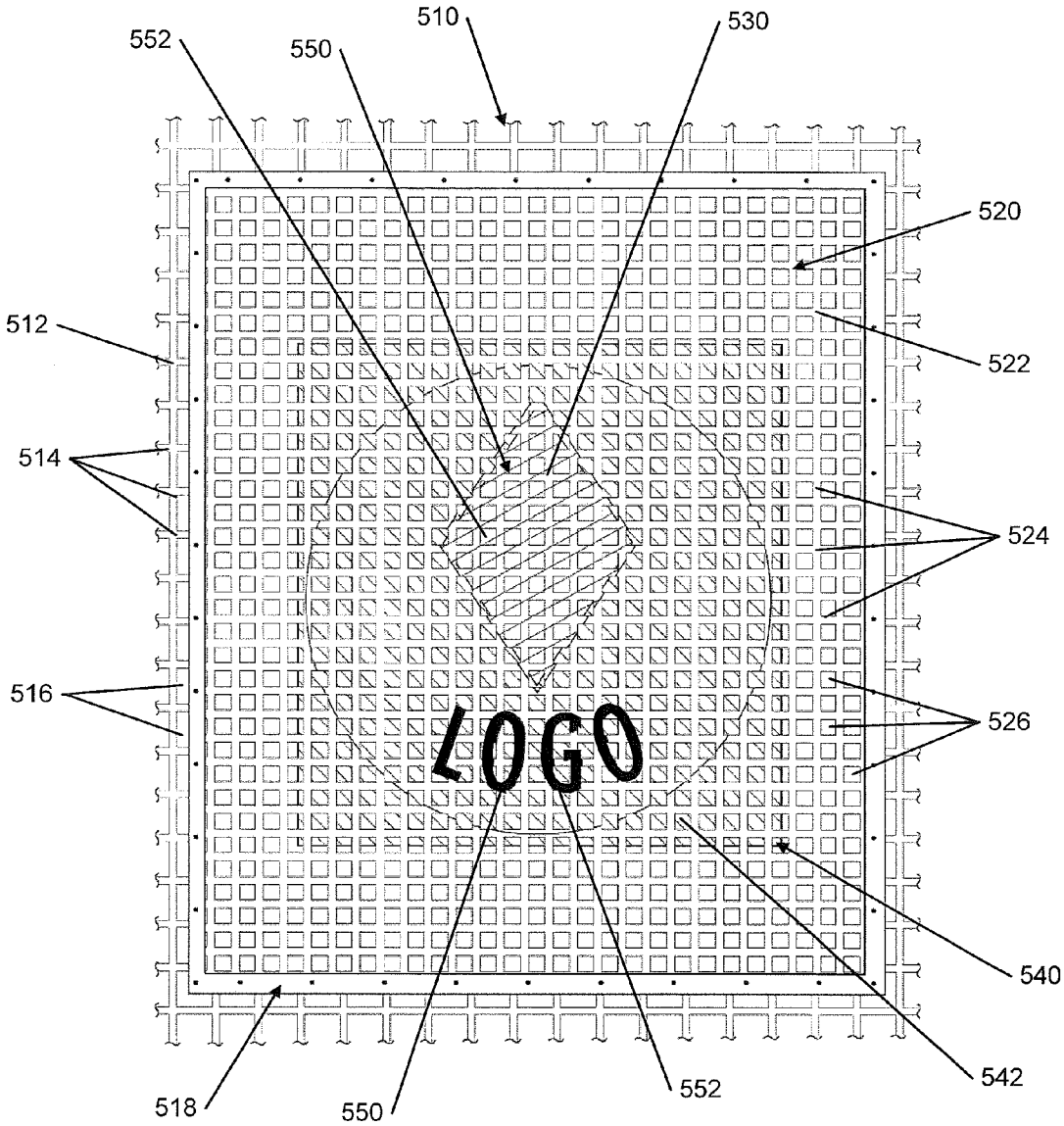
FIG. 5D illustrates a close-up view of the netting apparatus as shown in FIG. 5C in accordance with this invention.

In another embodiment, the netting apparatus 500 as illustrated in FIGS. 5A and 5B and described above may include additional features. As shown in FIGS. 5C and 5D, the netting apparatus 500 may also include a set of panel pieces 550. In an example, one piece can be used rather than a set. The set of panel pieces 550 may include a solid material 552. The set of panel pieces 550 may be cut into the shape of the logo 530 or letters on the logo 530. Additionally, the set of panel pieces 550 may be same color as the painted logo 530 on the second net 520.

The set of panel pieces 550 may be located between the second net 520 and the first panel 540. Additionally, the set of panel pieces 550 may be attached as an appliqué matched with the logo 530 and letters of the logo 530. The set of panel pieces 550 may be attached to the second net 520 or the first panel 540 by a variety of methods such as sewn together, clipped with fasteners, glued, or any other similar method used to attach the panel pieces to the second net or first panel. The set of panel pieces 550 may be see-through, such that the spectators are able to significantly view the sporting event or sports activities through the panel pieces 550 with the panel pieces 550 are attached. In another embodiment, without departing from the invention, the set of panel pieces 550 may be not significantly see-through and thereby significantly obstructs the spectator's view, such that the spectators are not able to significantly view the sporting event or sports activities through the panel pieces 550 when the panel pieces 550 are attached.

Figure 6A:
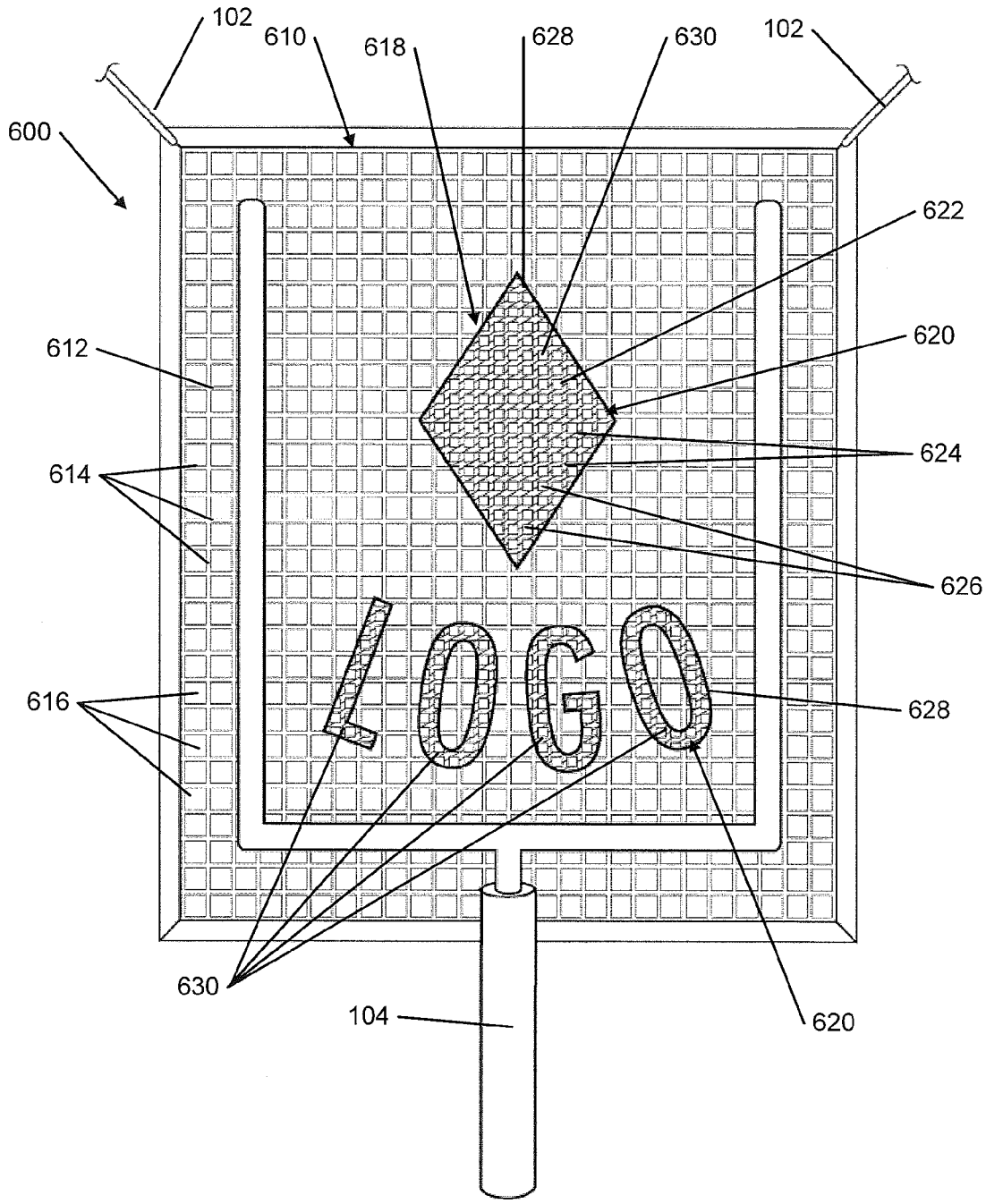
FIG. 6A illustrates a front plan view of another example netting apparatus in accordance with this invention.
Figure 6B:
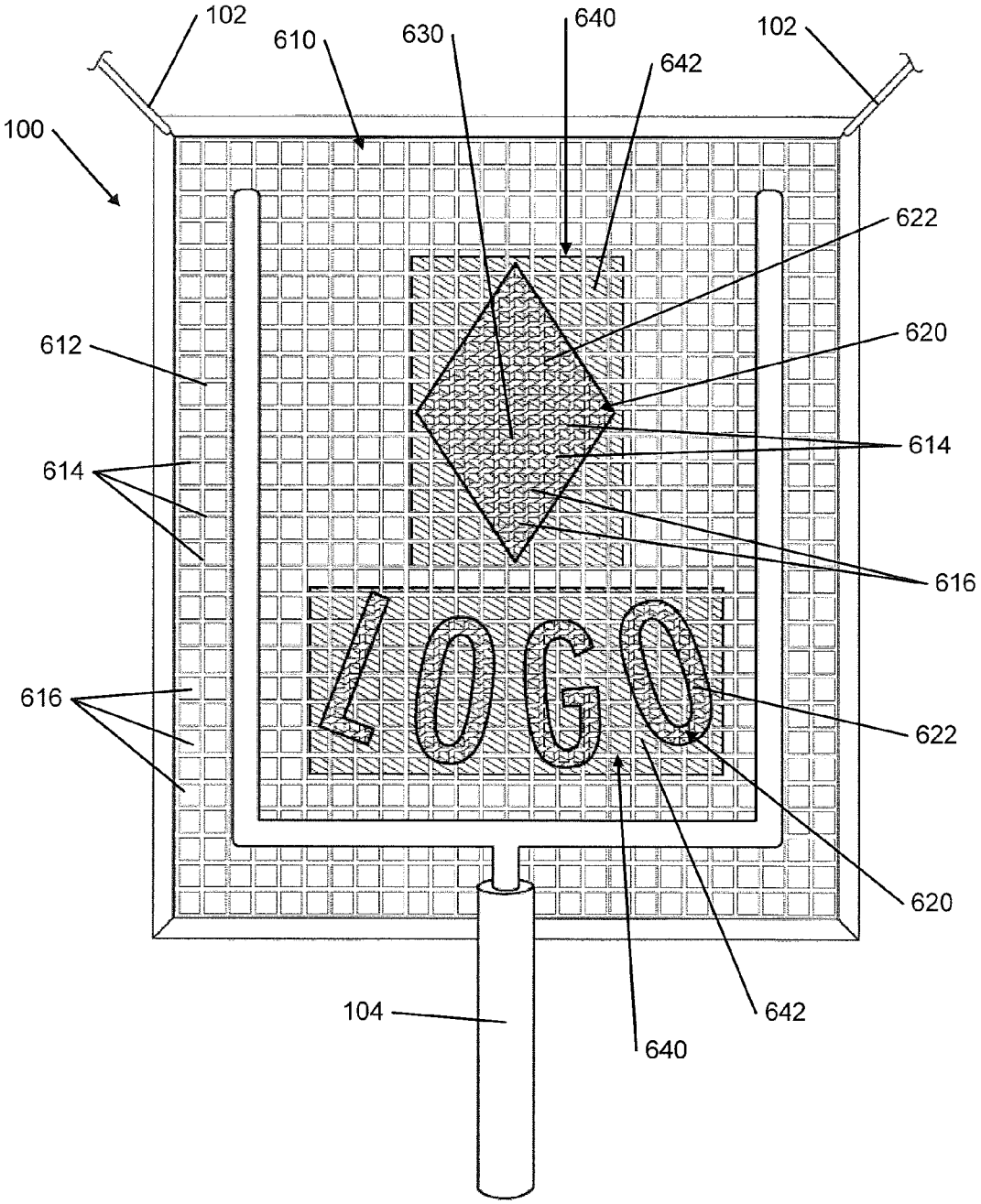
FIG. 6B illustrates a front plan view of another example netting apparatus in accordance with this invention.

FIGS. 6A and 6B illustrate examples according to this invention similar to that described above in conjunction with FIGS. 1A through 1D (the same or similar reference numbers are used in FIGS. 6A and 6B as those used in FIGS. 1A through 1D to denote the same or similar parts). FIG. 6A illustrates a netting apparatus 600 for use at a sporting event. In another example in accordance with this invention, as shown in FIG. 6A, the netting apparatus 600 is generally comprised of a first net 610 and a mesh netting piece or set of mesh netting pieces 620. The first net 610 may comprise a first mesh netting 612. The set of mesh netting pieces 620 may comprise a second mesh netting 622.

The first net 610 includes the first mesh netting 612 that may include strands 614 or threads. The strands 614 may consist of textile fibers, metal, plastics, or other materials. The strands 614 define a plurality of mesh openings 616. The mesh openings 616 may be sized such that the first mesh netting 612 is adapted to safely stop a ball or other object without significant obstructions of view through the first mesh netting 612. Additionally, the first net 610 may include multiple cut-out portions 618. A cut-out portion or the cut-out portions 618 may be in the shape and size of a logo 630 or letters on the logo 630.

The mesh netting piece or set of mesh netting pieces 620 includes the second mesh netting 622 that may include strands 624 or threads. The strands 624 may consist of textile fibers, metal, plastics, or other materials. The strands 624 define a plurality of mesh openings 626. The mesh openings 626 may be sized such that the second mesh netting 622 is adapted to safely stop a ball or other object without significant obstructions of view through the second mesh netting 622. The mesh openings 626 of the set of mesh netting pieces 620 may be smaller than the mesh openings 616 of the first net 610. The mesh netting piece or set of mesh netting pieces 620 may be cut into the shape of the logo 630 or letters on the logo 630 and may be suitably colored for the logo 630 or the letters on the logo 630.

As illustrated in FIG. 6A, the set of mesh netting pieces 620 may be located in the area of the cut-out portions 618 of the first net 610 by individually attaching each mesh netting piece 620 to the corresponding cut-out portion 618. The set of mesh netting pieces 620 may be attached to the first net 610 by a variety of methods such as sewn together, clipped with fasteners, glued, or any other similar method used to attach the mesh netting pieces to the first net.

As illustrated in FIG. 6A, the set of mesh netting pieces 620 attached to the cut-out portions on the first net 610 create a logo 630. Additionally, the set of mesh netting pieces 620 may be painted on one side with some bleed through to the other side or painted on both sides. The smaller-sized mesh openings 626 of the set of mesh netting pieces 620 thereby provides more surface area for the paint and/or coloring so that the logo 630 can be better viewed by the spectators. Additionally, the set of mesh netting pieces 620 may have a black outlining 628 on the edges to make the logo 630 and letters on the logo 630 more visible.

In another embodiment, the netting apparatus 600 as illustrated in FIG. 6A and described above may include additional features. As shown in FIG. 6B, the netting apparatus 600 may also include a panel 640 in the shape of a square or rectangle. The panel 640 may be located behind the set of mesh netting pieces 620 that create the logo 630 and letters of the logo 630. The panel 640 may include one large panel located behind the set of mesh netting pieces 620 and logo 630. In an alternate embodiment, the panel 640 may include smaller multiple panels 640 included with the netting apparatus 600 and located at different locations behind different parts of the logo 630 (as is specifically shown in FIG. 6B).

The panel 640 may include a solid material 642. The panel 640 may be attached to the first net 610 by a variety of methods such as sewn together, clipped with fasteners, glued, or any other similar method used to attach the panel 640 to the first net 610. The panel 640 may be see-through, such that the spectators are able to significantly view the sporting event or sports activities through the panel 640 with the panel 640 is in position. In another embodiment, without departing from the invention, the panel 640 may be not significantly see-through and thereby significantly obstructs the spectator's view, such that the spectators are not able to significantly view the sporting event or sports activities through the panel 640 when the panel 640 is in position.

The solid material 642 may provide a contrast with the logo 630 and/or letters of the logo 630 because of the color or patterns of the solid material 642. Additionally, the solid material 642 may or may not be colored or painted with the logo 630. The solid material 642 of the panel 640 may consist of a nonwoven fabric, polyester, linen, or cotton, woven fabric, cloth or any other material with the properties beneficial for the panel 640, as described above for solid materials.

FIG. 7 illustrates examples according to this invention similar to that described above in conjunction with FIGS. 1A, 1B1, and 1B2 (the same or similar reference numbers are used in FIG. 7 as those used in FIGS. 1A, 1B1, and 1B2 to denote the same or similar parts). FIG. 7 illustrates a netting apparatus 700 for use at a sporting event that may display advertising content. The netting apparatus 700 is generally comprised of a first panel 710, a second panel 720, and a set of panel pieces 740. The set of panel pieces 740 also may be a single piece according to some examples. The first panel 710 may comprise an open mesh netting 712. The second panel 720 may comprise a solid material 722. The set of panel pieces 740 may include a solid material 742. The set of panel pieces 740 may be cut into the shape of a logo 730 or letters on the logo 730. Additionally, the set of panel pieces 740 may be same color as the painted logo 730 on the second net 710.

The first panel 710 may include an open mesh netting 712 that may include strands 714 or threads. The strands 714 may consist of textile fibers, metal, plastics, or other materials. The strands 714 define a plurality of mesh openings 716. The mesh openings 716 may be sized such that the open mesh netting 712 is adapted to safely stop a ball or other object without significant obstructions of view through the open mesh netting 712.

The second panel 720 may include a solid material 722. The second panel 720 may be located either directly in front of the first panel 710 or directly behind the first panel 710. Additionally, the second panel 720 may be attached to the first panel 710 by a variety of methods such as sewn together, clipped with fasteners, or any other similar method used to attach the first panel 710 to the second panel 720. The second panel 720 may be see-through, such that the spectators are able to significantly view the sporting event or sports activities through the second panel 720 when the second panel 720 is in position. In another embodiment, without departing from the invention, the second panel 720 may be not significantly see-through and thereby significantly obstructs the spectator's view, such that the spectators are not able to significantly view the sporting event or sports activities through the second panel 720 when the second panel 720 is in position.

The set of panel pieces 740 may be located between the first panel 710 and the second panel 720. Additionally, the set of panel pieces 740 may be attached as an appliqué matched with the logo 730 and letters of the logo 730. The set of panel pieces 740 may be attached to the first panel 710 or the second panel 720 by a variety of methods such as sewn together, clipped with fasteners, glued, or any other similar method used to attach the panel pieces to the first panel or second panel. The set of panel pieces 740 may be see-through, such that the spectators are able to significantly view the sporting event or sports activities through the panel pieces 740 with the panel pieces 740 are attached. In another embodiment, without departing from the invention, the set of panel pieces 740 may be not significantly see-through and thereby significantly obstructs the spectator's view, such that the spectators are not able to significantly view the sporting event or sports activities through the panel pieces 740 when the panel pieces 740 are attached.

Figure 7A:
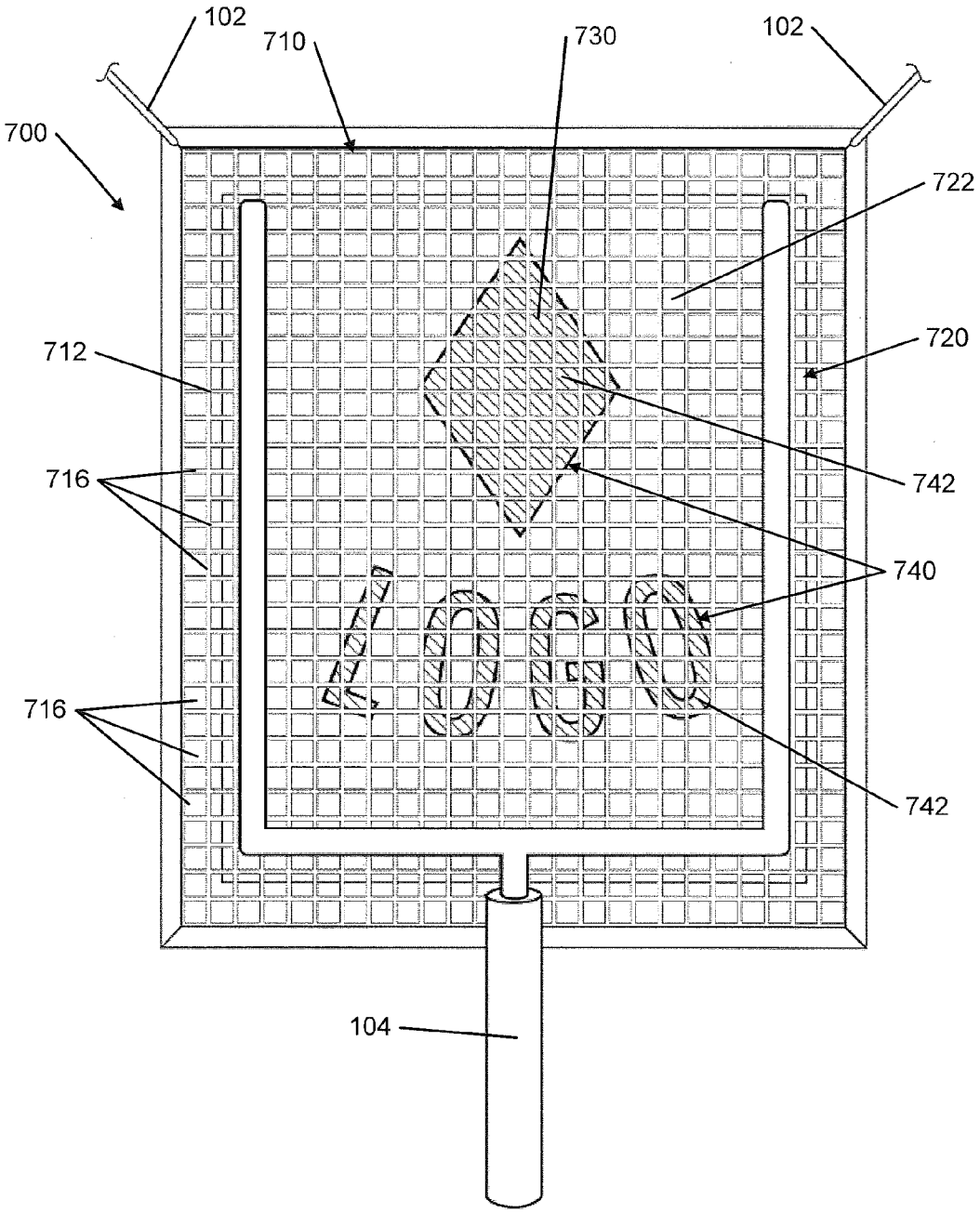
FIG. 7A illustrates a front plan view of another example netting apparatus in accordance with this invention.
Figure 7B:
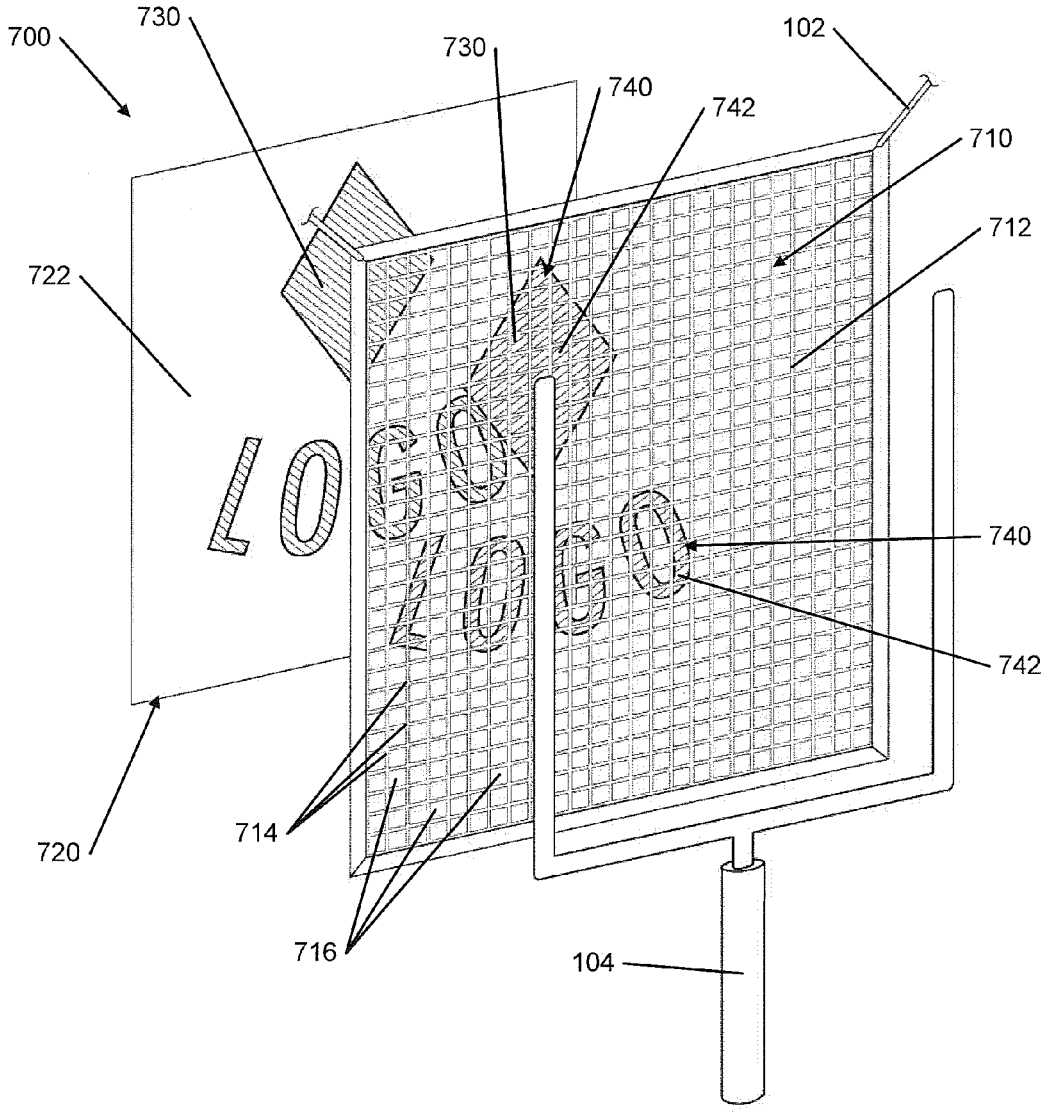
FIG. 7B illustrates a front perspective exploded view of the netting apparatus as shown in FIG. 7A in accordance with this invention.

As illustrated in FIGS. 7A and 7B, the first panel 710 or the second panel 720 can be colored or painted with a design and or words. The mesh netting 712 can be colored or painted with the logo 730. Additionally, the mesh netting 712 may be painted on one side with some bleed through to the other side or painted on both sides. Also, the solid material 722 can be colored or painted with the logo 730 in a manner that matches the logo 730 painted on the mesh netting 712. Also, the solid material 722 may not be painted or colored with the logo 730. Moreover, only the solid material 722 may be painted or colored with the logo 730 with the mesh netting 712 not painted or colored with the logo 730. To better improve the contrast with the mesh netting 712, the solid material 722 may be a solid color, such as black or white and the solid material 722 may be a color that is different from the color of the mesh netting 712. In an embodiment, the color of the colored portion of the solid material 722 and color of the colored portion of the mesh netting 712 can be identical to strengthen the visual appearance.

Figure 8:
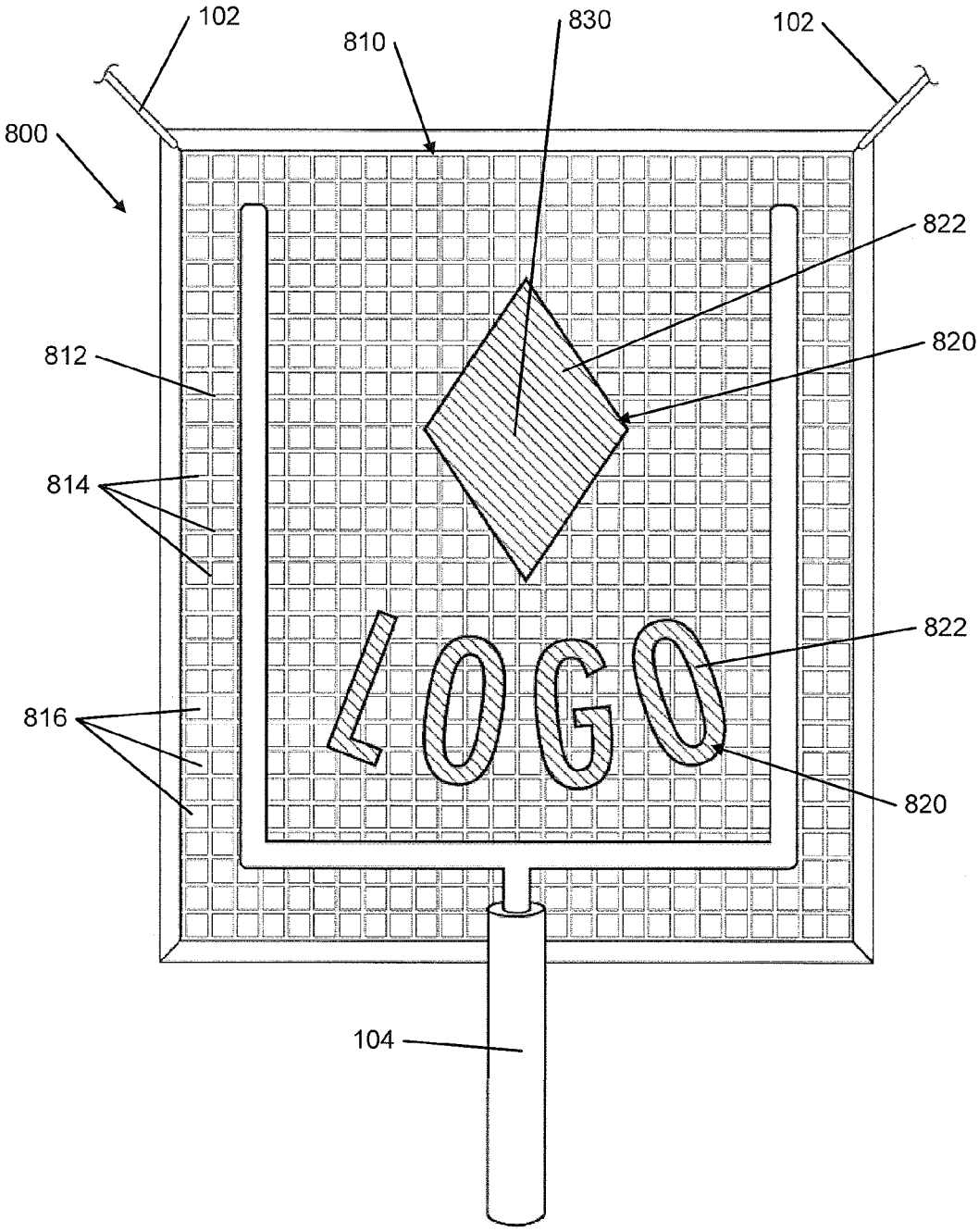
FIG. 8 illustrates a front plan view of another example netting apparatus in accordance with this invention.

FIG. 8 illustrates an example according to this invention similar to that described above in conjunction with FIGS. 1A through 1D (the same or similar reference numbers are used in FIG. 8 as those used in FIGS. 1A through 1D to denote the same or similar parts). FIG. 8 illustrates a netting apparatus 800 for use at a sporting event. In another example in accordance with this invention, as shown in FIG. 8, the netting apparatus 800 is generally comprised of a first net 810 and a set of panel pieces 820. In an example, one panel piece may be used, rather than a set of panel pieces. The first net 810 may comprise a first mesh netting 812. The set of panel pieces 820 may include a solid material 822. The set of panel pieces 820 may be cut into the shape of a logo 830 or letters on the logo 830. Additionally, the set of panel pieces 820 may be the same color as a painted logo 830 on the first net 810.

The first net 810 includes the first mesh netting 812 that may include strands 814 or threads. The strands 814 may consist of textile fibers, metal, plastics, or other materials. The strands 814 define a plurality of mesh openings 816. The mesh openings 816 may be sized such that the first mesh netting 812 is adapted to safely stop a ball or other object without significant obstructions of view through the first mesh netting 812.

The set of panel pieces 820 may be located behind the first net 810. Additionally, the set of panel pieces 820 may be attached as an appliqué matched with the logo 830 and letters of the logo 830. The set of panel pieces 820 may be individually attached to the first net 810 by a variety of methods such as sewn together, clipped with fasteners, glued, or any other similar method used to attach the panel pieces to the first net. The set of panel pieces 820 may be see-through, such that the spectators are able to significantly view the sporting event or sports activities through the panel pieces 820 with the panel pieces 820 are attached. In another embodiment, without departing from the invention, the set of panel pieces 820 may be not significantly see-through and thereby significantly obstructs the spectator's view, such that the spectators are not able to significantly view the sporting event or sports activities through the panel pieces 820 when the panel pieces 820 are attached.

The first net 810 can be colored or painted with a logo 830 and or letters of the logo 830. The mesh netting 812 can be colored or painted with the logo 830. Additionally, the mesh netting 812 may be painted on one side with some bleed through to the other side or painted on both sides. Also, the solid material 822 can be colored or painted in a manner that matches the logo 830 painted on the mesh netting 812. Also, the solid material 822 may not be painted or colored to match the logo 830. In an embodiment, the color of the colored portion of the solid material 822 and the color of the colored portion of the mesh netting 812 can be identical to strengthen the visual appearance. In another example, the first net 810 can contain no painting or coloring.

Figure 9:
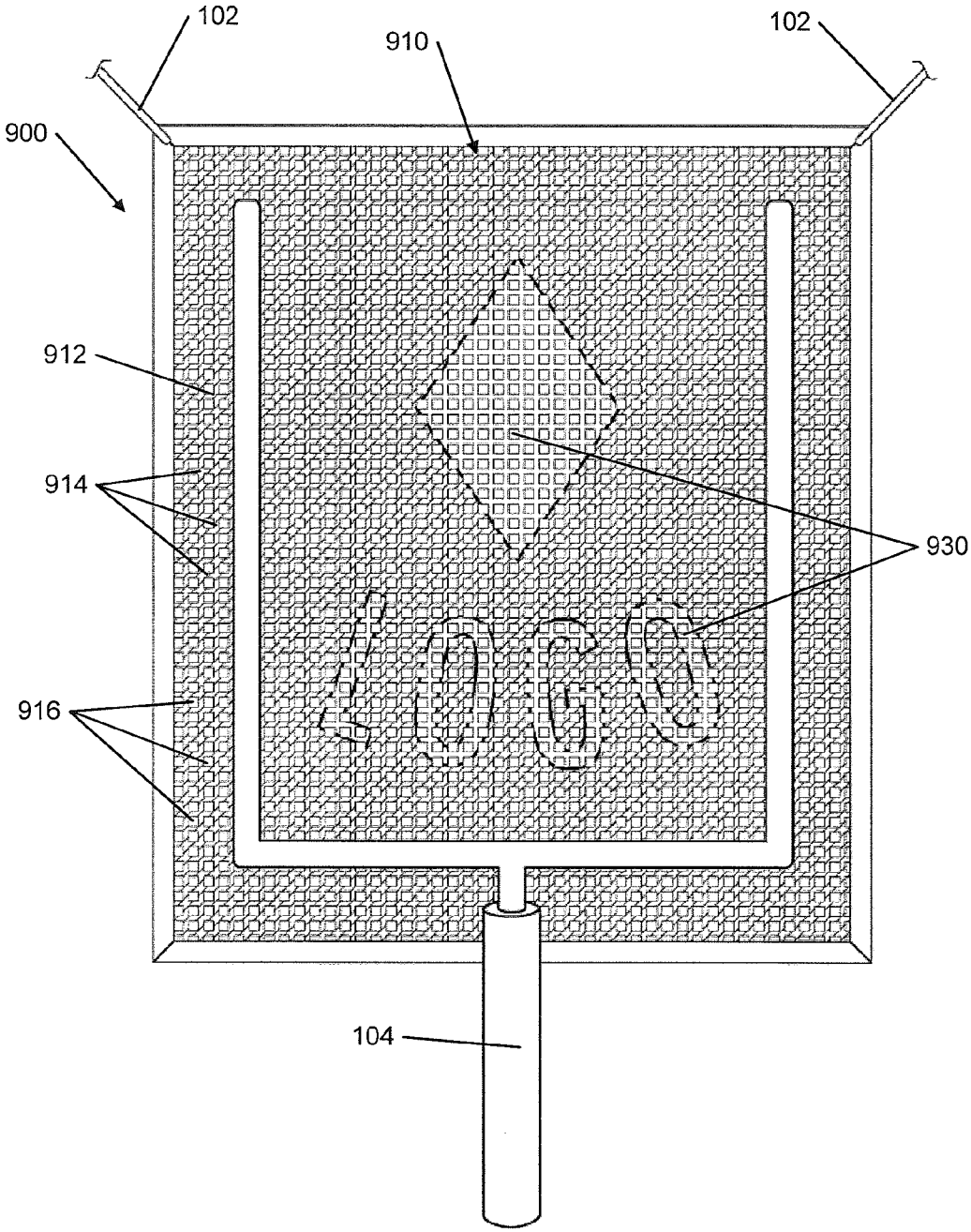
FIG. 9 illustrates a front plan view of another example netting apparatus in accordance with this invention.

FIG. 9 illustrates an example according to this invention similar to that described above in conjunction with FIGS. 1A through 1D (the same or similar reference numbers are used in FIG. 9 as those used in FIGS. 1A through 1D to denote the same or similar parts). FIG. 9 illustrates a netting apparatus 900 for use at a sporting event. In another example in accordance with this invention, as shown in FIG. 9, the netting apparatus 900 is generally comprised of a first net 910 with a logo 930 painted or colored on the first net 910. The first net 910 may comprise a first mesh netting 912.

The first net 910 may include the first mesh netting 912 that may include strands 914 or threads. The strands 914 may consist of textile fibers, metal, plastics, or other materials. The strands 914 define a plurality of mesh openings 916. The mesh openings 916 may be sized such that the first mesh netting 912 is adapted to safely stop a ball or other object without significant obstructions of view through the first mesh netting 912.

The first net 910 can be colored or painted with a logo 930 and or letters of the logo 930. The mesh netting 912 can be colored or painted with the logo 930. Additionally, the mesh netting 912 may be painted on one side with some bleed through to the other side or painted on both sides. The logo 930 and letters of the logo 930 may be painted in white to best contrast with the first net 910. Additionally, the logo 930 and letters of the logo 930 may be painted in any other color combination to contrast with the first net 910.

Additional net features may be included with all of the above examples of this invention without departing from the invention. In accordance with this invention, the netting apparatus may include an adhesive that is applied on the net or solid material attached to the net. The adhesive may hold the football or other ball once the ball is in contact with the netting apparatus. The adhesive may be temporary. The adhesive may be sprayed or wiped onto the netting apparatus or onto particular portions of the netting apparatus, such as the logo or letters of the logo. Alternatively, without departing from this invention, the adhesive also may be permanent and incorporated into the netting apparatus, such as to the logo or letters of the logo.

Additionally, in accordance with this invention, the netting apparatus may include a three-dimensional feature. The three-dimensional feature may cause the logo to "catch" a ball when the ball is in contact with the netting apparatus. The logo may "catch" the ball by extending outward towards the ball when the ball makes contact with the netting apparatus. In an exemplary embodiment, the logo may be a pair of hands to "catch" the ball. The logo may also have a feature that causes the three-dimensional extending to activate when the ball contacts the netting apparatus or a certain area of the netting apparatus.

Additionally, in accordance with this invention, the netting apparatus may include an electronic sensor. The electronic sensor may cause an action when a ball hits or contacts the netting apparatus. Additionally, the electronic sensor may cause an action when a ball hits or contacts a specific area of the netting apparatus, such as the logo or letters of the logo. The electronic sensor may cause an action such as: lighting various lights that surround the netting apparatus, sounding a fight song or other spirit cheer, or causing the logo or letters of the logo to change. Other various actions may be initiated by the electronic sensor without departing from this invention.

CONCLUSION

The present invention is disclosed above and in the accompanying drawings with reference to a variety of examples. The purpose served by the disclosure, however, is to provide an example of the various features and concepts related to the invention, not to limit the scope of the invention. One skilled in the relevant art will recognize that numerous variations and modifications may be made to the aspects described above without departing from the scope of the present invention, as defined by the appended claims.

We claim:

1. A netting apparatus adapted to display advertising content at a sporting event, the netting apparatus comprising:

a net comprising a first mesh netting, wherein the first mesh netting is adapted to safely stop a ball without significant obstruction of view through the first mesh netting, wherein the first mesh netting includes one or more cut-out portions;

a plurality of mesh netting pieces comprising a second mesh netting different than the first mesh netting, wherein the second mesh netting is adapted to safely stop a ball without significant obstruction of view through the second mesh netting, and further wherein the plurality of mesh netting pieces are located behind the one or more cut-out portions and the plurality of mesh netting pieces are attached to the one or more cut-out portions to create a first logo, and wherein the one or more cut-out portions and the plurality of mesh netting pieces include matching words or design to create the first logo; and a panel comprising a solid material, wherein the panel is attached to the net and the panel is located either in front of the net or behind the net, wherein the solid material is colored or painted with an image of a second logo, wherein the first logo and the second logo include matching words or design and wherein the location of the first logo is aligned therewith the second logo when the panel is attached to the net.

2. A netting apparatus according to claim 1, wherein in a raised configuration, the netting apparatus is adapted for displaying advertising content to spectators and wherein the netting apparatus exhibits no visible wrinkles to spectators viewing the netting apparatus when the netting apparatus is raised from a stored configuration.

3. A netting apparatus according to claim 1, wherein the first mesh netting is painted on a first side and at least partially painted on a second side opposite the first side.

4. A netting apparatus according to claim 1, wherein the solid material comprises a nonwoven fabric.

5. A netting apparatus according to claim 4, wherein the panel is painted or colored similar to the net and the plurality of mesh netting pieces.

6. A netting apparatus according to claim 1, wherein the plurality of mesh netting pieces are cut into a shape of the first logo.

7. A netting apparatus according to claim 1, wherein the plurality of mesh netting pieces include a black outlining on the edges of the mesh netting pieces to make the first logo and the second logo more visible.

8. A sports blocking and display apparatus for use at a sporting event comprising:

a net comprising a first mesh netting, wherein the first mesh netting is adapted to safely stop a ball without significant obstruction of view through the first mesh netting, wherein the first mesh netting includes one or more cut-out portions;

a plurality of mesh netting pieces comprising a second mesh netting different than the first mesh netting, wherein the second mesh netting is adapted to safely stop a ball without significant obstruction of view through the second mesh netting, and further wherein the plurality of mesh netting pieces are located behind the one or more cut-out portions and the plurality of mesh netting pieces are attached to the one or more cut-out portions to create a first logo; and a panel in the shape of a square or rectangle and comprising a solid material, wherein the solid material comprises a nonwoven fabric, wherein the panel is attached to the net and the panel is located behind the plurality of mesh netting pieces that create the first logo, wherein the solid material is colored or painted with an image of a second logo, wherein the first logo and the second logo include matching words or design and wherein the location of the first logo is aligned therewith the second logo when the panel is attached to the net.

9. A sports blocking and display apparatus according to claim 8, wherein the panel is painted or colored similar to the net and the plurality of mesh netting pieces.

10. A sports blocking and display apparatus according to claim 8, wherein the panel is adapted to safely stop a ball without significant obstruction of view through the panel.

11. A sports blocking and display apparatus according to claim 8, wherein the panel provides a contrast with the first logo and the second logo because of a color or a pattern of the panel.

12. A sports blocking and display apparatus according to claim 8, wherein the one or more cut-out portions and the plurality of mesh netting pieces include matching words or design to create the first logo and the second logo.

13. A sports blocking and display apparatus according to claim 8, wherein the panel includes smaller multiple panels located at different locations behind different portions of the second logo.

14. A sports blocking and display apparatus according to claim 8, wherein the first mesh netting is painted on a first side and at least partially painted on a second side opposite the first side.

15. A netting apparatus for displaying advertising content at a sporting event comprising:

a net comprising a first mesh netting, wherein the first mesh netting is adapted to safely stop a ball without significant obstruction of view through the first mesh netting, wherein the first mesh netting includes one or more cut-out portions;

a plurality of mesh netting pieces comprising a second mesh netting different than the first mesh netting, wherein the second mesh netting is adapted to safely stop a ball without significant obstruction of view through the second mesh netting, wherein the plurality of mesh netting pieces are attached to the one or more cut-out portions; and a panel comprising a solid material, wherein the panel is attached to the net and the panel is located either in front of the net or behind the net, wherein the first mesh netting is colored or painted with an image of a first logo and the second mesh netting is colored or painted with an image of a second logo such that the color of the colored portion of the first mesh netting and the color of the colored portion of the second mesh netting are identical to enhance the visual appearance of the netting apparatus, wherein the first logo and the second logo include matching words or design, wherein the solid material is colored or painted with an image of a third logo, wherein the first logo, the second logo, and the third logo include matching words or design and wherein the location of the first logo and second logo are aligned therewith the third logo when the panel is attached to the net.

16. A netting apparatus according to claim 15, wherein in a raised configuration, the netting apparatus is adapted for displaying advertising content to spectators and wherein the netting apparatus exhibits no visible wrinkles to spectators viewing the netting apparatus when the netting apparatus is raised from a stored configuration.

17. A netting apparatus according to claim 15, wherein the solid material comprises a nonwoven fabric.

18. A netting apparatus according to claim 15, wherein the plurality of mesh netting pieces are cut into a shape of the first logo or the second logo.

19. A netting apparatus according to claim 15, wherein the plurality of mesh netting pieces are located behind the one or more cut-out portions.

20. A netting apparatus according to claim 15, wherein the one or more cut-out portions and the plurality of mesh netting pieces include matching words or design to create the first logo and the second logo.

* * * * *